US008922473B2

(12) United States Patent
Iwamoto

(10) Patent No.: US 8,922,473 B2
(45) Date of Patent: Dec. 30, 2014

(54) DISPLAY DEVICE WITH BIDIRECTIONAL SHIFT REGISTER AND METHOD OF DRIVING SAME

(75) Inventor: Akihisa Iwamoto, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 116 days.

(21) Appl. No.: 13/877,921

(22) PCT Filed: Oct. 17, 2011

(86) PCT No.: PCT/JP2011/073797

§ 371 (c)(1),
(2), (4) Date: Apr. 5, 2013

(87) PCT Pub. No.: WO2012/053466

PCT Pub. Date: Apr. 26, 2012

(65) Prior Publication Data

US 2013/0187843 A1 Jul. 25, 2013

(30) Foreign Application Priority Data

Oct. 21, 2010 (JP) ..... 2010-236294

(51) Int. Cl.
*G09G 3/36* (2006.01)

(52) U.S. Cl.
CPC ..... *G09G 3/3611* (2013.01); *G09G 3/3677* (2013.01); *G09G 3/3688* (2013.01); *G09G 2310/0283* (2013.01); *G09G 2310/08* (2013.01); *G09G 2330/021* (2013.01)
USPC ..... 345/100

(58) Field of Classification Search
CPC ..... G09G 3/3688; G09G 2310/0232; G09G 2310/0283; G09G 2310/0286
USPC ..... 345/99, 100
See application file for complete search history.

(56) References Cited

U.S. PATENT DOCUMENTS 5,363,424 A * 11/1994 Fujisawa ..... 377/69
5,440,304 A * 8/1995 Hirai ..... 341/100

(Continued)

FOREIGN PATENT DOCUMENTS

JP 05249927 A * 9/1993
JP 10074062 A * 3/1998

(Continued)

OTHER PUBLICATIONS

Official Communication issued in International Patent Application No. PCT/JP2011/073797, mailed on Jan. 17, 2012.

*Primary Examiner* — Allison Johnson
(74) *Attorney, Agent, or Firm* — Keating & Bennett, LLP

(57) ABSTRACT

Provided is a display device capable of correctly displaying an image when surplus outputs are produced within a driver, regardless of a shifting direction of a shift register within the driver, without bringing about increase in cost and increase in consumption current. A timing controller (200) is provided with a register (22) that can store data indicating the length of a horizontal back porch when a shifting direction of a shift register within a source driver (300) is in a forward direction and data indicating the length of the horizontal back porch when the shifting direction is in an inverse direction. A source-start-pulse generation unit (21) within the timing controller (200) refers to the data within the register (22) according to the shifting direction of the shift register, and generates one of a first source start pulse signal (SSP1) for the forward direction and a second source start pulse signal (SSP2) for the inverse direction.

9 Claims, 23 Drawing Sheets

(56) References Cited

U.S. PATENT DOCUMENTS

| | | | | |
|---|---|---|---|---|
| 2004/0252112 | A1 | 12/2004 | Fukuda et al. | |
| 2005/0110733 | A1 | 5/2005 | Sasaki et al. | |
| 2005/0128170 | A1* | 6/2005 | Kang et al. | 345/87 |
| 2006/0139291 | A1* | 6/2006 | Cho et al. | 345/100 |

FOREIGN PATENT DOCUMENTS

| | | | | |
|---|---|---|---|---|
| JP | 2005-004120 | A | | 1/2005 |
| JP | 2005-181982 | A | | 7/2005 |
| JP | 2010139535 | A | * | 6/2010 |

* cited by examiner

DISPLAY DEVICE WITH BIDIRECTIONAL SHIFT REGISTER AND METHOD OF DRIVING SAME

TECHNICAL FIELD

The present invention relates to display devices and methods of driving the same, and in particular to a display device provided with a driver having a bidirectional shift register and a method of driving the same.

BACKGROUND ART

A typical display device is provided with a source driver for driving source bus lines (video signal lines) and a gate driver for driving gate bus lines (scanning signal lines). These drivers are provided with a plurality of output terminals to be connected to a plurality of lines (source bus lines or gate bus lines) in a display unit in accordance with a versatile resolution. From the output terminals of the source driver, video signals for an image to be displayed are outputted. From the output terminals of the gate driver, scanning signals for writing video signals to pixel capacitances line by line are outputted. It should be noted that there have conventionally been many cases in which the driver that functionally constitutes a single component of a display device is configured by a plurality of semiconductor chips.

In the meantime, in recent years, there is a case in which a panel having a resolution different from versatile resolutions (hereinafter referred to as a "specially-shaped panel") is employed for a display device. When a normal driver is used to drive such a specially-shaped panel, the number of lines (e.g., source bus lines) provided within a display unit may not match the number of output terminals provided within a driver (e.g., a source driver), and a surplus may be resulted from an output from the driver. For example, a case is considered in which an SVGA-type (number of pixels: 800×600) liquid crystal panel is driven using two source driving IC chips SD1, SD2 each having 960 output terminals as illustrated in FIG. 25. In a case of an RGB color display device, a single pixel is configured by three sub-pixels including R (red), G (green), and B (blue), and thus the number of source bus lines is (600×3=) 1800. Here, as for the source driving IC chip SD1, 960 output terminals are connected respectively to source bus lines SL1-SL960 within the display unit. In contrast, as for the source driving IC chip SD2, although 840 output terminals are connected respectively to the source bus lines SL961-SL1800 within the display unit, the remaining 120 output terminals are not connected to the source bus lines within the display unit (see a reference number 9 in FIG. 25). Therefore, outputs from these 120 output terminals may not contribute to display of an image. Hereinafter, such outputs are referred to as "surplus outputs".

The above drivers (the source driver and the gate driver) include shift registers. For example, in the source driver, sampling (acquisition) of the video signals transmitted to the source driver from a timing controller and such is performed by sampling pulses sequentially outputted from respective stages of a shift register. Then, an image is displayed in the display unit by driving each of the source bus lines based on the sampled video signals. In the meantime, there is also a driver that employs a bidirectional shift register, since a mode of implementation of the driver (IC chip) to the panel is not uniform. In a display device provided with such a driver, depending on the mode of implementation of the driver, a shifting direction of data in the shift register is made opposite to a regular direction (forward direction). This allows sampling of data within the driver in an order opposite to the regular order.

Regarding the present invention, there have been known the following conventional techniques. According to the invention disclosed in Japanese Patent Application Laid-Open No. 2005-4120, by providing a line memory in a timing controller, it is possible to change an order of display data transmitted to a source driver from the timing controller. According to the invention disclosed in Japanese Patent Application Laid-Open No. 2005-181982, by operating the source drivers separately in two groups, it is possible to operate the display device even when a horizontal blanking interval is 0 in the case in which surplus outputs are produced in the source drivers.

PRIOR ART DOCUMENTS

Patent Documents

[Patent Document 1] Japanese Patent Application Laid-Open No. 2005-4120

[Patent Document 2] Japanese Patent Application Laid-Open No. 2005-181982

SUMMARY OF THE INVENTION

Problems To Be Solved By the Invention

However, in the case in which surplus outputs are produced in the driver employing a bidirectional shift register, when the shifting direction is made to an inverse direction, a display position of the image can be displaced in the following manner. For example, when the shifting direction of a shift register in a source driver is made to an inverse direction in a configuration illustrated in FIG. 25, a part of display data is taken to lines indicated by the reference number 9 in FIG. 25, and as a result, a part of an image to be displayed can be dropped, and the display position of the image can be displaced as compared to a case in which the shifting direction is in the forward direction.

According to the display device described in Japanese Patent Application Laid-Open No. 2005-4120, although it is possible to change the order of the display data transmitted to the source driver, it brings about increase in cost and increase in consumption current since a line memory is required in order to temporarily hold the display data. Further, the invention disclosed in Japanese Patent Application Laid-Open No. 2005-181982 is applied to a display device configured such that surplus outputs are produced on both ends of the driver, and cannot be applied to a display device configured such that surplus outputs are produced only on one end of the driver as illustrated in FIG. 25.

Thus, an object of the present invention is to provide a display device capable of correctly displaying an image when surplus outputs are produced within a driver, regardless of a shifting direction of a shift register within the driver, without bringing about increase in cost and increase in consumption current.

Means for Solving the Problems

A first aspect of the present invention is directed to a display device comprising a display unit; a plurality of signal lines disposed in the display unit; and a signal line driving unit including a bidirectional shift register having a plurality of output stages, the signal line driving unit being configured to drive the plurality of signal lines based on pulses outputted sequentially from the plurality of output stages along with a shifting operation of the bidirectional shift register, wherein the display device comprises:

a register unit configured to store first period length data and second period length data, the first period length data indicating a length of a time period from a starting point of a unit period till a time point at which the shifting operation of the bidirectional shift register is to be started when a shifting direction of the bidirectional shift register is in a first direction, the second period length data indicating a length of a time period from a starting point of a unit period till a time point at which the shifting operation of the bidirectional shift register is to be started when the shifting direction of the bidirectional shift register is in a second direction which is an inverse direction of the first direction; and a shifting-operation-start instruction signal generation unit configured to generate a first shifting-operation-start instruction signal and a second shifting-operation-start instruction signal as signals indicating starting timing of the shifting operation of the bidirectional shift register in the respective unit periods, the first shifting-operation-start instruction signal causing the signal line driving unit to operate so that the shifting direction of the bidirectional shift register is in the first direction, the second shifting-operation-start instruction signal causing the signal line driving unit to operate so that the shifting direction of the bidirectional shift register is in the second direction, wherein the shifting-operation-start instruction signal generation unit receives a shifting-direction instruction signal indicating the shifting direction of the bidirectional shift register, and generates the first shifting-operation-start instruction signal based on the first period length data when the shifting-direction instruction signal indicates the first direction, and the second shifting-operation-start instruction signal based on the second period length data when the shifting-direction instruction signal indicates the second direction.

According to a second aspect of the present invention, in the first aspect of the present invention, the display device further comprises a non-volatile memory configured to store the first period length data and the second period length data, wherein the first period length data and the second period length data are read from the non-volatile memory to the register unit after power activation.

According to a third aspect of the present invention, in the first aspect of the present invention, the display device further comprises a unit-period-length recording unit configured to store unit period length data indicating a length of the unit period, wherein the register unit is configured to be able to store a negative value for at least one of the first period length data and the second period length data, and the shifting-operation-start instruction signal generation unit generates the first shifting-operation-start instruction signal based on the unit period length data and the first period length data when the first period length data takes the negative value in a case in which the shifting-direction instruction signal indicates the first direction, and the second shifting-operation-start instruction signal based on the unit period length data and the second period length data when the second period length data takes the negative value in a case in which the shifting-direction instruction signal indicates the second direction.

According to a fourth aspect of the present invention, in the first aspect of the present invention, a plurality of video signal lines as the plurality of signal lines are disposed in the display unit, and the signal line driving unit is a video signal line driving unit configured to drive the plurality of video signal lines.

According to a fifth aspect of the present invention, in the first aspect of the present invention, a plurality of scanning signal lines as the plurality of signal lines are disposed in the display unit, and the signal line driving unit is a scanning signal line driving unit configured to drive the plurality of scanning signal lines.

According to a sixth aspect of the present invention, in the first aspect of the present invention, a plurality of video signal lines and a plurality of scanning signal lines as the plurality of signal lines are disposed in the display unit, and the signal line driving unit is constituted by a video signal line driving unit configured to drive the plurality of video signal lines and a scanning signal line driving unit configured to drive the plurality of scanning signal lines.

According to a seventh aspect of the present invention, in the sixth aspect of the present invention, the display device further comprises a timing signal generation unit including the register unit and the shifting-operation-start instruction signal generation unit, and configured to generate a timing signal for controlling operations of the video signal line driving unit and the scanning signal line driving unit, wherein at least two of the video signal line driving unit, the scanning signal line driving unit, and the timing signal generation unit are formed within a single semiconductor chip.

According to an eighth aspect of the present invention, in the first aspect of the present invention, the signal line driving unit is constituted by one or more semiconductor chips including a semiconductor chip having a dummy terminal as an output terminal that is not connected to any of the plurality of signal lines, and data indicating a length of a time period in which the shifting operation of the bidirectional shift register is performed in output stages, each corresponding to the dummy terminal, out of the plurality of output stages is stored in the register unit as one of the first period length data and the second period length data.

A ninth aspect of the present invention is directed to a driving method of a display device including a display unit; a plurality of signal lines disposed in the display unit; and a signal line driving unit including a bidirectional shift register having a plurality of output stages, the signal line driving unit being configured to drive the plurality of signal lines based on pulses outputted sequentially from the plurality of output stages along with a shifting operation of the bidirectional shift register, the method comprising:

a shifting-direction instruction signal receiving step of receiving a shifting-direction instruction signal indicating a shifting direction of the bidirectional shift register; and a shifting-operation-start instruction signal generating step of generating one of a first shifting-operation-start instruction signal and a second shifting-operation-start instruction signal as a signal indicating starting timing of the shifting operation of the bidirectional shift register in each unit period, the first shifting-operation-start instruction signal causing the signal line driving unit to operate so that the shifting direction of the bidirectional shift register is in a first direction, the second shifting-operation-start instruction signal causing the signal line driving unit to operate so that the shifting direction of the bidirectional shift register is in a second direction which is an inverse direction of the first direction, wherein the display device further includes a register unit configured to store first period length data and second period length data, the first period length data indicating a length of a time period from a starting point of a unit period till a time point at which the shifting operation of the bidirectional shift register is to be started when the shifting direction of the bidirectional shift register is in the first direction, the second period length data indicating a length of a time period from a starting point of a unit period till a time point at which the shifting operation of the bidirectional shift register is to be started when the shifting direction of the bidirectional shift register is in the second direction, and in the shifting-operation-start instruction signal generating step, the first shifting-operation-start instruction signal is generated based on the first period length data when the shifting-direction instruction signal indicates the first direction, and the second shifting-operation-start instruction signal is generated based on the second period length data when the shifting-direction instruction signal indicates the second direction.

Effects of the Invention

According to the first aspect of the present invention, the display device is provided with the register unit configured to store, as the data (the period length data) indicating the length of the time period from the starting point of the unit period (the horizontal scanning period or the vertical scanning period) till the starting point of the shifting operation in the bidirectional shift register within the signal line driving unit, the data for the case in which the shifting operation is performed in the first direction and the data for the case in which the shifting operation is performed in the second direction (a direction opposite to the first direction). Then, the shifting-operation-start instruction signal generation unit generates, based on the period length data stored in the register unit, one of the first shifting-operation-start instruction signal causing to perform the shifting operation in the first direction and the second shifting-operation-start instruction signal causing to perform the shifting operation in the second direction in accordance with the shifting direction indicated by the shifting-direction instruction signal. Here, by setting the value of the period length data appropriately in the case in which surplus outputs are produced within the signal line driving unit, it is possible to start the shifting operation of the bidirectional shift register at timing earlier (as compared to a case in which the shifting operation is performed from a side on which the surplus outputs are not produced) by a time period corresponding to a time period in which the shifting operation is performed in output stages (of the bidirectional shift register) which correspond to the surplus outputs, when the shifting operation is performed from a side on which the surplus outputs are produced. Accordingly, it is possible to prevent the display data from being taken in lines for dummy outputting in the video signal line driving unit, or to prevent a writing pulse from being outputted from the scanning signal line driving unit to the lines for dummy outputting during a period in which video signals are to be written to pixel capacitances. With this, a display position of an image may not be displaced between the case in which the shifting direction of the bidirectional shift register is in the first direction (e.g., forward direction) and the case in which the shifting direction is in the second direction (e.g., inverse direction). Further, there may not be a drop of the image regardless of the shifting direction of the bidirectional shift register.

According to the second aspect of the present invention, it is possible to write the period length data to a non-volatile memory appropriately depending on a mode of implementation of the signal line driving unit to a panel.

According to the third aspect of the present invention, it is possible to generate the first shifting-operation-start instruction signal and the second shifting-operation-start instruction signal based on the unit period length data indicating the length of the unit period (the horizontal scanning period or the vertical scanning period) and the period length data set to the negative value. Accordingly, it is possible to start the shifting operation in the bidirectional shift register at timing earlier than the starting point of the unit period, and the back porch during each unit period can be reduced. With this, it is possible to reduce the length of the unit period, to reduce a clock frequency, and to reduce consumption current. Here, when the value of the period length data is set appropriately, the display position of the image may not be displaced and there may not be a drop of the image.

According to the fourth aspect of the present invention, in a display device having a video signal line driving unit in which surplus outputs are produced, it is possible to prevent the display data from being taken in the lines for dummy outputting when the shifting operation in the bidirectional shift register is performed from the side on which the surplus outputs are produced. With this, similarly to the first aspect of the present invention, a display position of an image may not be displaced between the case in which the shifting direction of the bidirectional shift register is in the first direction and the case in which the shifting direction is in the second direction. Further, there may not be a drop of the image regardless of the shifting direction of the bidirectional shift register.

According to the fifth aspect of the present invention, in a display device having a scanning signal line driving unit in which surplus outputs are produced, when the shifting operation in the bidirectional shift register is performed from the side on which the surplus outputs are produced, it is possible to prevent the writing pulse from being outputted from the scanning signal line driving unit to the lines for dummy outputting during the period in which video signals are to be written to the pixel capacitances. With this, similarly to the first aspect of the present invention, a display position of an image may not be displaced between the case in which the shifting direction of the bidirectional shift register is in the first direction and the case in which the shifting direction is in the second direction. Further, there may not be a drop of the image regardless of the shifting direction of the bidirectional shift register.

According to the sixth aspect of the present invention, in the display device configured such that surplus outputs are produced in at least one of the video signal line driving unit and the scanning signal line driving unit, it is possible to obtain the same effects as those in the first aspect of the present invention.

According to the seventh aspect of the present invention, in the display device in which at least two of the video signal line driving unit, the scanning signal line driving unit, and the timing signal generation unit are formed within a single semiconductor chip, it is possible to obtain the same effects as those in the first aspect of the present invention.

According to the eighth aspect of the present invention, when the shifting operation is performed from a side on which the surplus outputs are produced in the signal line driving unit, the shifting operation starts at timing earlier (as compared to a case in which the shifting operation is performed from a side on which the surplus outputs are not produced) by a time period corresponding to a time period in which the shifting operation is performed in output stages (of the bidirectional shift register) which correspond to the surplus outputs, and therefore it is possible to reliably prevent the display position of the image from being displaced and a drop of the image from occurring.

According to the ninth aspect of the present invention, it is possible to obtain the same effects as those in the first aspect of the present invention with the method of driving the display device.

MODES FOR CARRYING OUT THE INVENTION

<1. First Embodiment>

<1.1 Entire Configuration>

Figure 2:
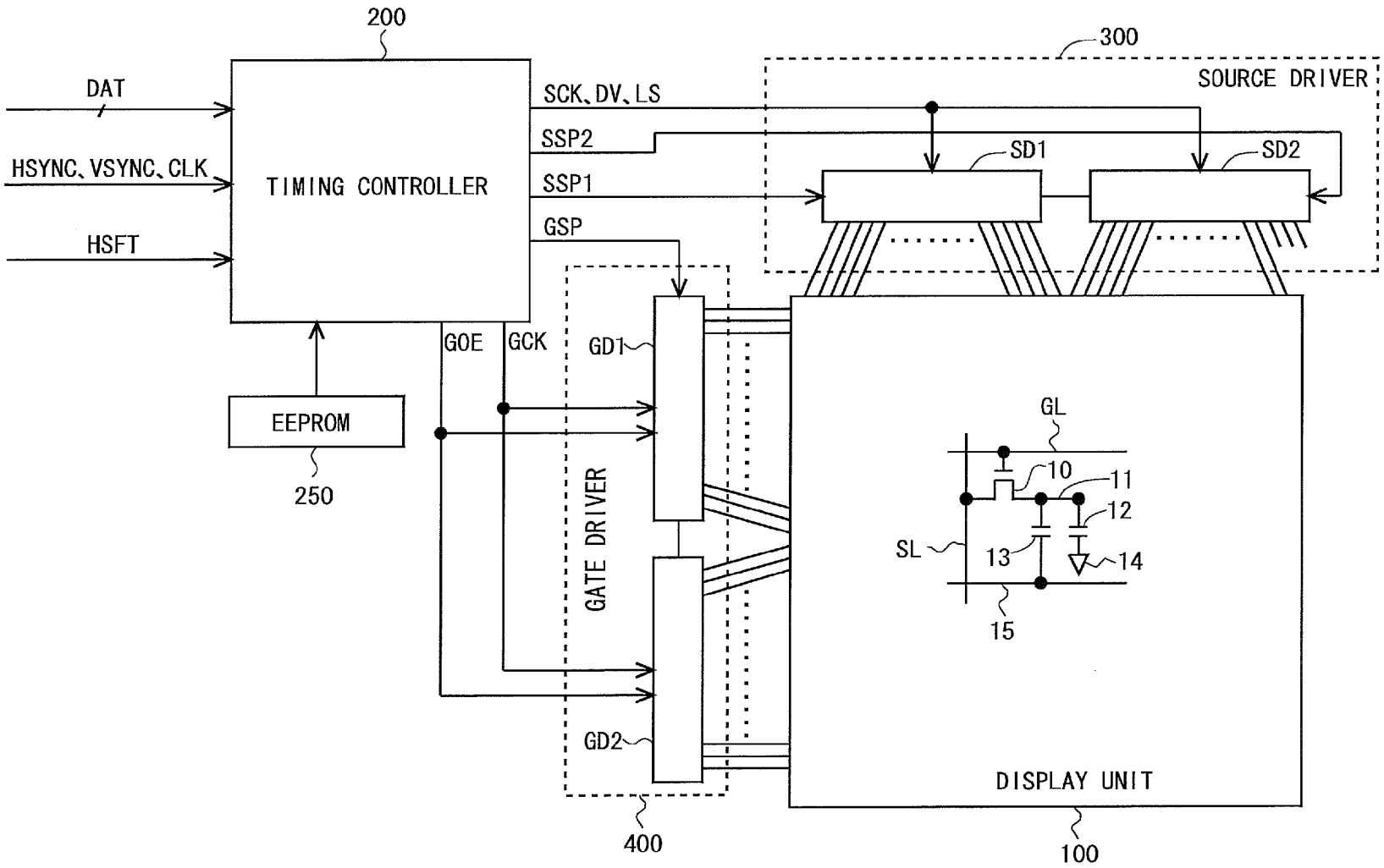
FIG. 2 is a block diagram illustrating an entire configuration of the liquid crystal display device according to the first embodiment.

FIG. 2 is a block diagram illustrating an entire configuration of a liquid crystal display device according to a first embodiment of the present invention. This liquid crystal display device is provided with a display unit 100, a timing controller 200, an EEPROM (electrically erasable read-only memory) 250, a source driver 300, and a gate driver 400. The EEPROM 250 is a non-volatile memory. The source driver 300 is configured by two semiconductor chips (source driving IC chips SD1, SD2). The gate driver 400 is configured by two semiconductor chips (gate driving IC chips GD1, GD2). It should be noted that the number of semiconductor chips that constitute the source driver 300 or the gate driver 400 is not limited to the above example. The following description assumes that the liquid crystal display device employs a SVGA type liquid crystal panel.

Figure 3:
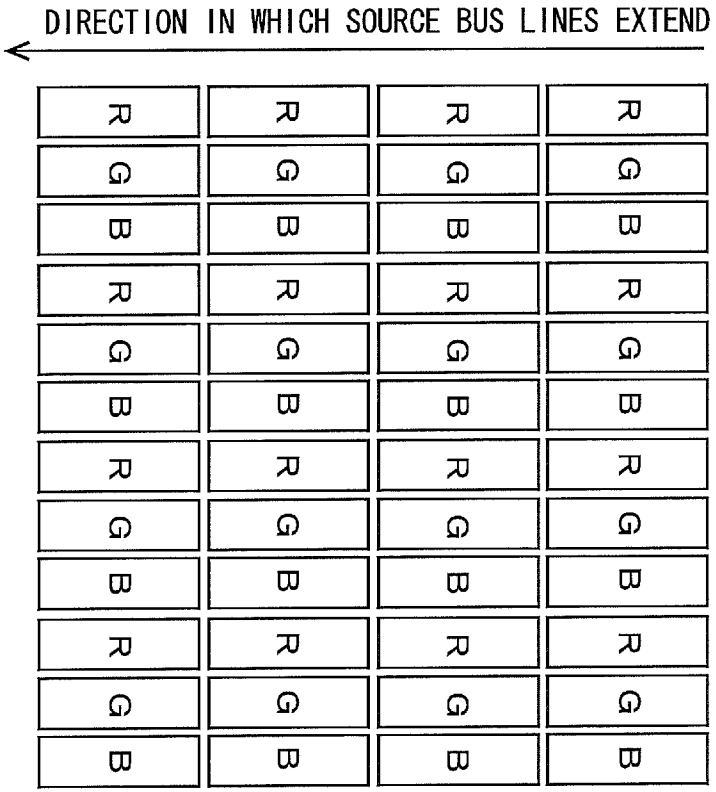
FIG. 3 is a diagram for illustration of a configuration of pixels according to the first embodiment.

The display unit 100 includes 1800 source bus lines (video signal lines) SL, 800 gate bus lines (scanning signal lines) GL, and a plurality of pixel formation portions provided corresponding to intersections between the source bus lines and the gate bus lines. The plurality of pixel formation portions are arranged in a matrix so as to configure a pixel array. Each pixel formation portion includes a TFT 10 as a switching element having a gate terminal connected to one of the gate bus lines GL that passes through a corresponding intersection and having a source terminal connected to one of the source bus lines SL that passes through the corresponding intersection, a pixel electrode 11 connected to a drain terminal of the TFT 10, a common electrode 14 and an auxiliary capacitance electrode 15 that are provided in common for the plurality of pixel formation portions, a liquid crystal capacitance 12 constituted by the pixel electrode 11 and the common electrode 14, and an auxiliary capacitance 13 constituted by the pixel electrode 11 and the auxiliary capacitance electrode 15. The liquid crystal capacitance 12 and the auxiliary capacitance 13 configure a pixel capacitance. Here, for the display unit 100 of FIG. 2, only the components associated with a single pixel formation portion are illustrated. A single pixel formation portion forms a single sub-pixel, and a so-called single pixel is configured by three sub-pixels of R (red), G (green), and B (blue). In this embodiment, as illustrated in FIG. 3, the configuration is such that each sub-pixel is in an elongate shape (vertically long shape) along a direction in which the source bus lines extend, and the sub-pixels of the same color are arranged in succession along the direction in which the source bus lines extend.

The timing controller 200 receives image data DAT, synchronization signals (a horizontal synchronization signal HSYNC, a vertical synchronization signal VSYNC, and a clock CLK), and a horizontal shifting-direction instruction signal HSFT. Here, the horizontal shifting-direction instruction signal HSFT is a signal for instructing a shifting direction of data in a shift register provided within the source driver 300. The timing controller 200 generates a source shift clock SCK, a digital video signal DV, and a latch strobe signal LS based on the image data DAT, the horizontal synchronization signal HSYNC, and the clock CLK, and outputs the same. The timing controller 200 also generates a source start pulse signal (a first source start pulse signal SSP1 or a second source start pulse signal SSP2) based on the horizontal synchronization signal HSYNC, the clock CLK, and the horizontal shifting-direction instruction signal HSFT, and outputs the same. In this embodiment, the first source start pulse signal SSP1 realizes a first shifting-operation-start instruction signal, and the second source start pulse signal SSP2 realizes a second shifting-operation-start instruction signal. The generation of the source start pulse signal will be described later in detail. The timing controller 200 further generates a gate start pulse signal GSP, agate shift clock GCK, and a gate output enable signal GOE based on the vertical synchronization signal VSYNC and the clock CLK, and outputs the same. Here, immediately after power activation of the liquid crystal display device, data stored in the EEPROM 250 is read to a register 22 (see FIG. 1), which will be described later, within the timing controller 200.

The source driver 300 receives the source start pulse signal (the first source start pulse signal SSP1 or the second source start pulse signal SSP2), the source shift clock SCK, the digital video signal DV, and the latch strobe signal LS that have been outputted from the timing controller 200, and applies a driving video signal to each of the source bus lines SL in order to charge the pixel capacitance of the corresponding pixel formation portion within the display unit 100. The gate driver 400 receives the gate start pulse signal GSP, the gate shift clock GCK, and the gate output enable signal GOE that have been outputted from the timing controller 200, and applies scanning signals that become active in a sequential manner to the gate bus lines GL within the display unit 100.

In this manner, by applying the driving video signal to each of the source bus lines SL and applying the scanning signal to each of the gate bus lines GL, an image based on the image data DAT that is externally supplied is displayed in the display unit 100.

<1.2 Detailed Configuration of Driving Unit>

Next, a detailed configuration of a driving unit (the source driver 300 and the gate driver 400) will be described. Here, the following configuration is described by way of example, and the present invention can be applied to a configuration other than this.

<1.2.1 Source Driver>

As illustrated in FIG. 2, the source driver 300 is configured by the source driving IC chip SD1 and the source driving IC chip SD2. Each of the source driving IC chips is provided with 960 output terminals. As for the source driving IC chip SD1, all of the output terminals are connected to the source bus lines SL within the display unit 100. As for the source driving IC chip SD2, although 840 output terminals are connected to the source bus lines SL within the display unit 100, the remaining 120 output terminals are not connected to the source bus lines SL within the display unit 100. In other words, in the source driving IC chip SD2, 120 surplus outputs are produced.

Figure 4:
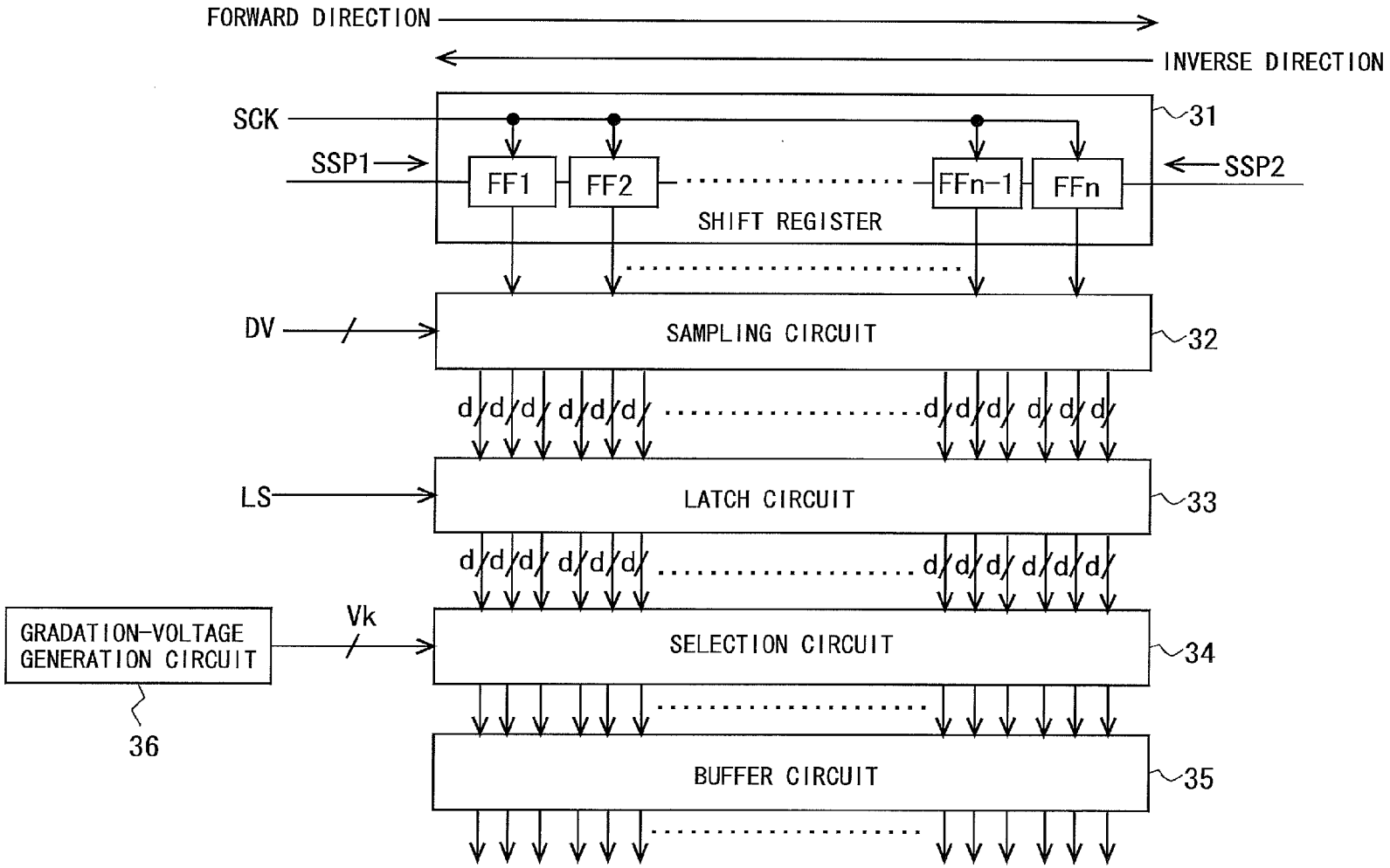
FIG. 4 is a block diagram illustrating a functional configuration of a source driver according to the first embodiment.

FIG. 4 is a block diagram illustrating a functional configuration of the source driver 300. The source driver 300 is provided with an n-stage shift register 31 including n flip-flops FF1-FFn (n=640), a sampling circuit 32 configured to output internal image signals d corresponding to the source bus lines SL respectively, a latch circuit 33 configured to take in and output the internal image signal d outputted from the sampling circuit 32 at timing of a pulse of the latch strobe signal LS transmitted from the timing controller 200, a selection circuit 34 for selecting a voltage to be applied to each of the source bus lines SL, a buffer circuit 35 configured to apply the voltage selected by the selection circuit 34 to each source bus line SL as a driving video signal, and a gradation-voltage generation circuit 36 configured to output voltages (gradation voltage group) Vk corresponding to gradation levels respectively. It should be noted that these components are physically divided into those included in the source driving IC chip SD1 and those included in the source driving IC chip SD2. Further, as described above, as for the source driving IC chip SD2, the 120 output terminals shown on the right hand in FIG. 2 and FIG. 4 are not connected to the source bus lines SL within the display unit 100.

To the shift register 31, the source start pulse signal (the first source start pulse signal SSP1 or the second source start pulse signal SSP2) and the source shift clock SCK are inputted. Here, when a shifting direction of data in the shift register 31 is made to a forward direction (a direction from FF1 toward FFn), the first source start pulse signal SSP1 is inputted to the flip-flop FF1 of a first stage in the shift register 31, whereas when the shifting direction is made to an inverse direction (a direction from FFn toward FF1), the second source start pulse signal SSP2 is inputted to the flip-flop FFn of an n-th stage in the shift register 31. The shift register 31 sequentially transfers a pulse included in the source start pulse signal from an input end to an output end based on the source shift clock SCK. Sampling pulses corresponding to the respective source bus lines SL are sequentially outputted from the shift register 31 according to the transfer of the pulse, and the sampling pulses are sequentially inputted into the sampling circuit 32.

Figure 5:
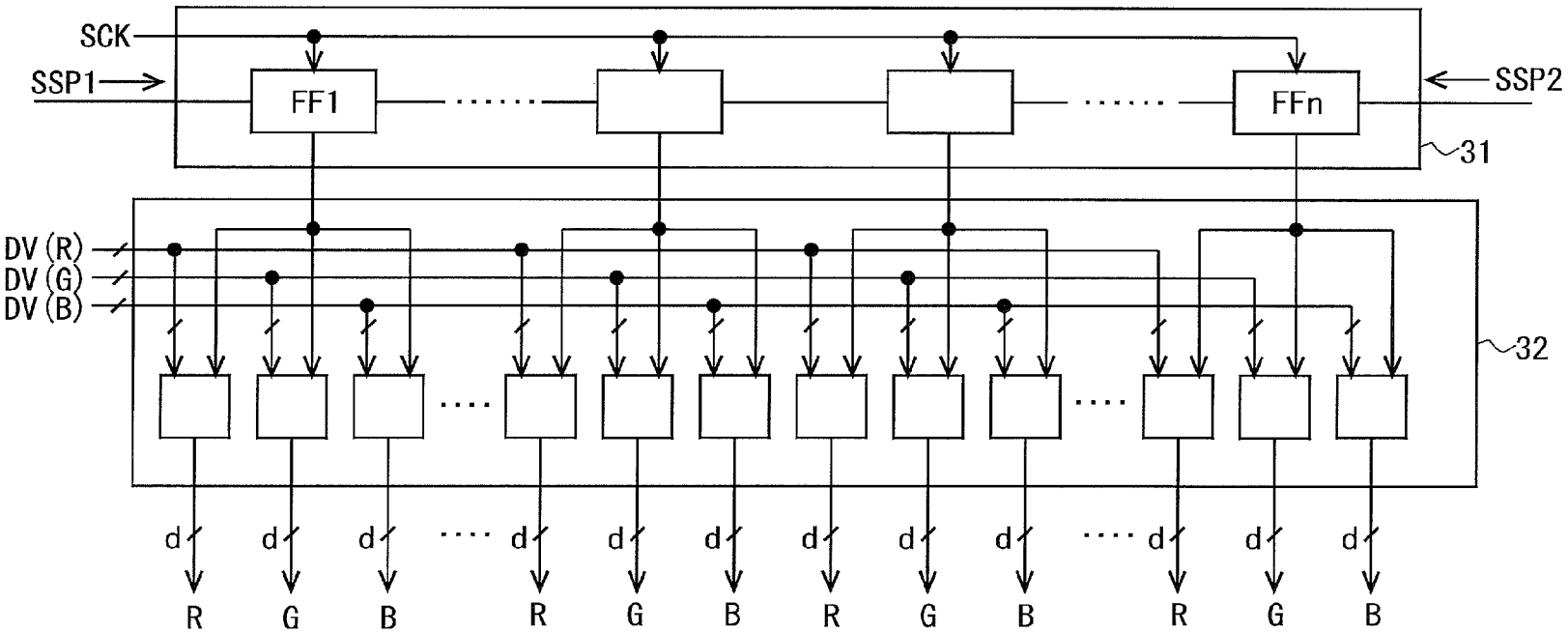
FIG. 5 is a block diagram illustrating a detailed configuration of a sampling circuit within the source driver according to the first embodiment.

The sampling circuit 32 samples the digital video signal DV transmitted from the timing controller 200 at timings of the sampling pulses outputted from the shift register 31, and outputs this as the internal image signals d. More specifically, as illustrated in FIG. 5, a digital video signal DV(R) for R (red), a digital video signal DV(G) for G (green), and a digital video signal DV(B) for B (blue) are inputted to the sampling circuit 32 through separate signal lines, and these signals are sampled at the same time based on a single sampling pulse. Then, the internal image signals d respectively for R (red), G (green), and B (blue) are outputted from the sampling circuit 32.

The latch circuit 33 takes in the internal image signals d outputted from the sampling circuit 32 at timing of a pulse of the latch strobe signal LS, and outputs the internal image signals d. The gradation-voltage generation circuit 36 generates voltages corresponding to the gradation levels based on a plurality of reference voltages supplied from a predetermined power circuit, and outputs these voltages as the gradation voltage group Vk. The selection circuit 34 selects one of the voltages in the gradation voltage group Vk outputted from the gradation-voltage generation circuit 36 based on the internal image signals d outputted from the latch circuit 33, and outputs the selected voltage. The buffer circuit 35 performs impedance conversion of the voltage outputted from the selection circuit 34 by a voltage follower, for example, and outputs the voltage after the conversion to the source bus lines SL as the driving video signal. Here, outputs from the 120 output terminals (the output terminals that are not connected to the source bus lines SL) of the source IC driving chip SD2 are dummy outputs.

<1.2.2 Gate Driver>

As illustrated in FIG. 2, the gate driver 400 is configured by the gate driving IC chip GD1 and the gate driving IC chip GD2. Each of the gate driving IC chips is provided with 400 output terminals. In this embodiment, both for the gate driving IC chip GD1 and for the gate driving IC chip GD2, all of the output terminals are connected to the gate bus lines GL within the display unit 100.

Figure 6:
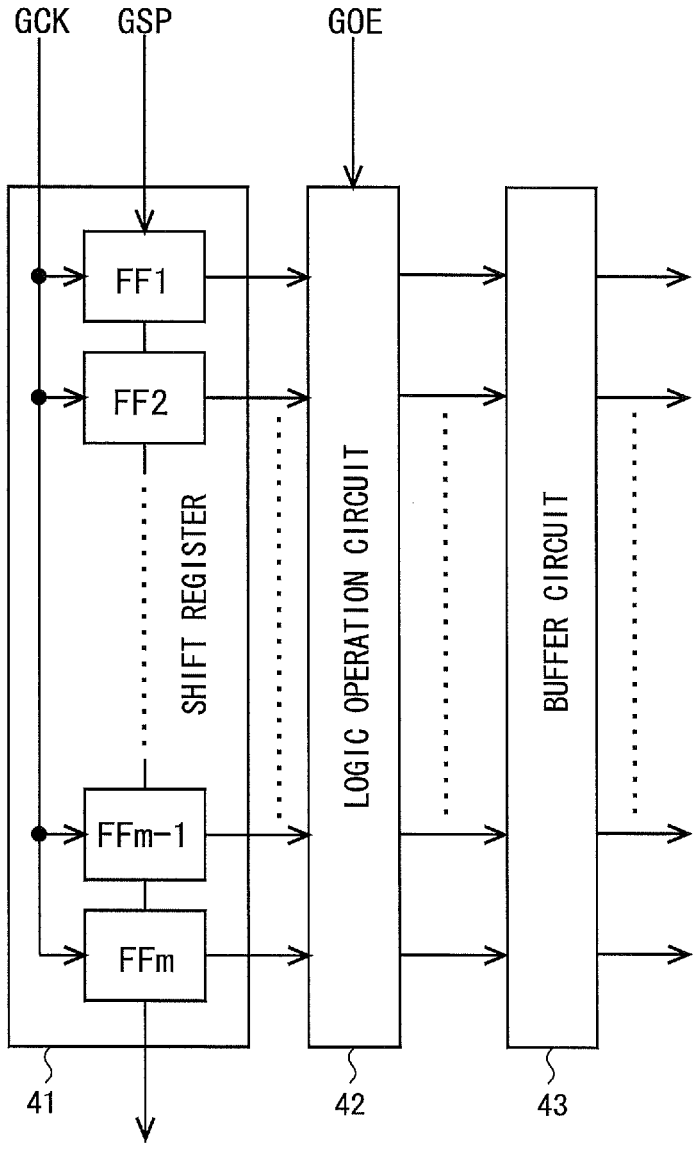
FIG. 6 is a block diagram illustrating a functional configuration of a gate driver according to the first embodiment.

FIG. 6 is a block diagram illustrating a functional configuration of the gate driver 400. The gate driver 400 is provided with an m-stage shift register 41 including m flip-flops FF1-FFm (m=800), a logic operation circuit 42, and a buffer circuit 43. To the shift register 41, the gate start pulse signal GSP and the gate shift clock GCK are inputted. The shift register 41, sequentially transfers a pulse included in the gate start pulse signal from an input end to an output end and sequentially outputs the pulse to the logic operation circuit 42 from each stage, based on the gate shift clock GCK. The logic operation circuit 42 performs a logic operation between the pulse outputted from each stage of the shift register 41 and the gate output enable signal GOE. Output signals from the logic operation circuit 42 are subjected to level conversion by the buffer circuit 43, and applied to each of the gate bus lines GL as the scanning signal.

<1.3 Generation of Source Start Pulse Signal>

Figure 1:
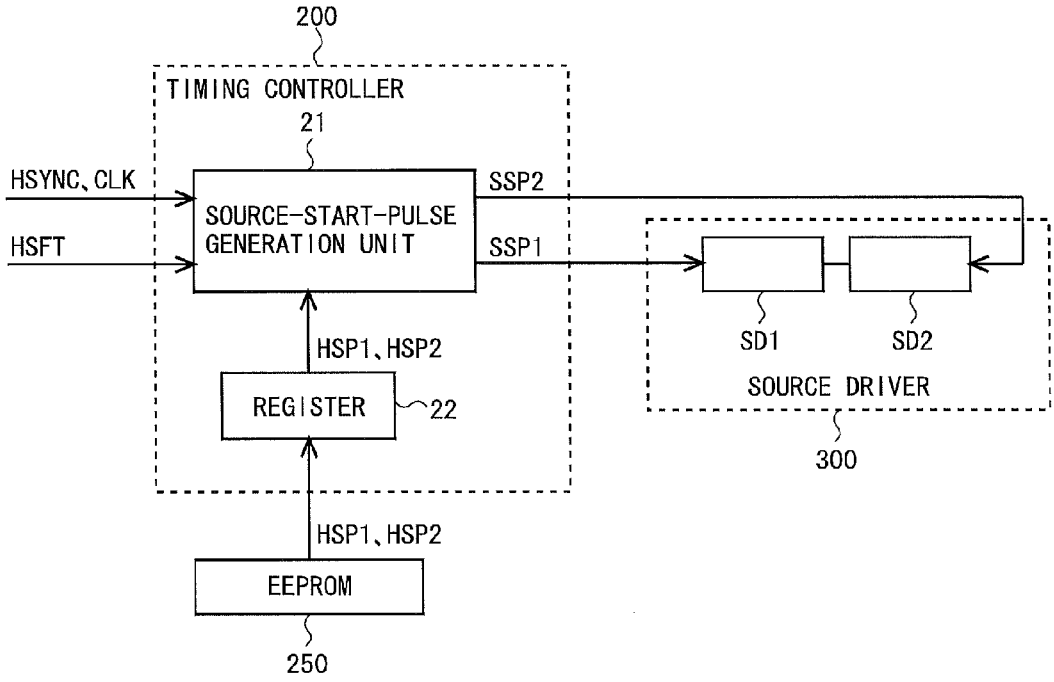
FIG. 1 is a block diagram illustrating a configuration of a main part relating to generation of a source start pulse signal in a liquid crystal display device according to a first embodiment of the present invention.

FIG. 1 is a block diagram illustrating a configuration of a main part relating to the generation of the source start pulse signal. The timing controller 200 is provided with, as components for generating the source start pulse signal, a source-start-pulse generation unit 21 and the register 22. Here, in this embodiment, the timing controller 200 realizes a timing signal generation unit, and the source-start-pulse generation unit 21 realizes a shifting-operation-start instruction signal generation unit.

The EEPROM 250 previously stores data (hereinafter referred to as "horizontal-shifting start setting data") indicating the length of a period (horizontal back porch) from a starting point of each horizontal scanning period to a time point at which shifting (transfer) of data (here, the source start pulse signal) is to be started in the shift register 31. Specifically, the horizontal-shifting start setting data for a case in which the shifting direction of the shift register 31 is made to the forward direction is stored in the EEPROM 250 as forward-direction horizontal-shifting start setting data HSP1, and the horizontal-shifting start setting data for a case in which the shifting direction of the shift register 31 is made to the inverse direction is stored in the EEPROM 250 as inverse-direction horizontal-shifting start setting data HSP2. In this embodiment, the forward-direction horizontal-shifting start setting data HSP1 realizes first period length data, and the inverse-direction horizontal-shifting start setting data HSP2 realizes second period length data. It should be noted that the number of clocks is typically used as the horizontal-shifting start setting data, and thus the following description is given assuming such.

The register 22 is configured to be able to store the forward-direction horizontal-shifting start setting data HSP1 and the inverse-direction horizontal-shifting start setting data HSP2. Then, upon power activation of this liquid crystal display device, the forward-direction horizontal-shifting start setting data HSP1 and the inverse-direction horizontal-shifting start setting data HSP2 previously stored in the EEPROM 250 are read to the register 22. It should be noted that in the following description, it is assumed that the horizontal shifting-direction instruction signal HSFT is a digital signal, the horizontal shifting-direction instruction signal HSFT is set to a low level when the shifting direction of the shift register 31 is made to the forward direction, and the horizontal shifting-direction instruction signal HSFT is set to a high level when the shifting direction of the shift register 31 is made to the inverse direction.

The source-start-pulse generation unit 21 generates the source start pulse signal (the first source start pulse signal SSP1 or the second source start pulse signal SSP2) based on the horizontal synchronization signal HSYNC, the clock CLK, and the horizontal shifting-direction instruction signal HSFT. Specifically, when the horizontal shifting-direction instruction signal HSFT is at the low level, the source-start-pulse generation unit 21 generates the first source start pulse signal SSP1 based on the horizontal synchronization signal HSYNC and the clock CLK, referring to the forward-direction horizontal-shifting start setting data HSP1 within the register 22. On the other hand, when the horizontal shifting-direction instruction signal HSFT is at the high level, the source-start-pulse generation unit 21 generates the second source start pulse signal SSP2 based on the horizontal synchronization signal HSYNC and the clock CLK, referring to the inverse-direction horizontal-shifting start setting data HSP2 within the register 22. Here, in this embodiment, an operation of the source-start-pulse generation unit 21 receiving the horizontal shifting-direction instruction signal HSFT realizes a shifting-direction instruction signal receiving step, and an operation of the source-start-pulse generation unit 21 generating the source start pulse signal realizes a shifting-operation-start instruction signal generating step.

Figure 7:
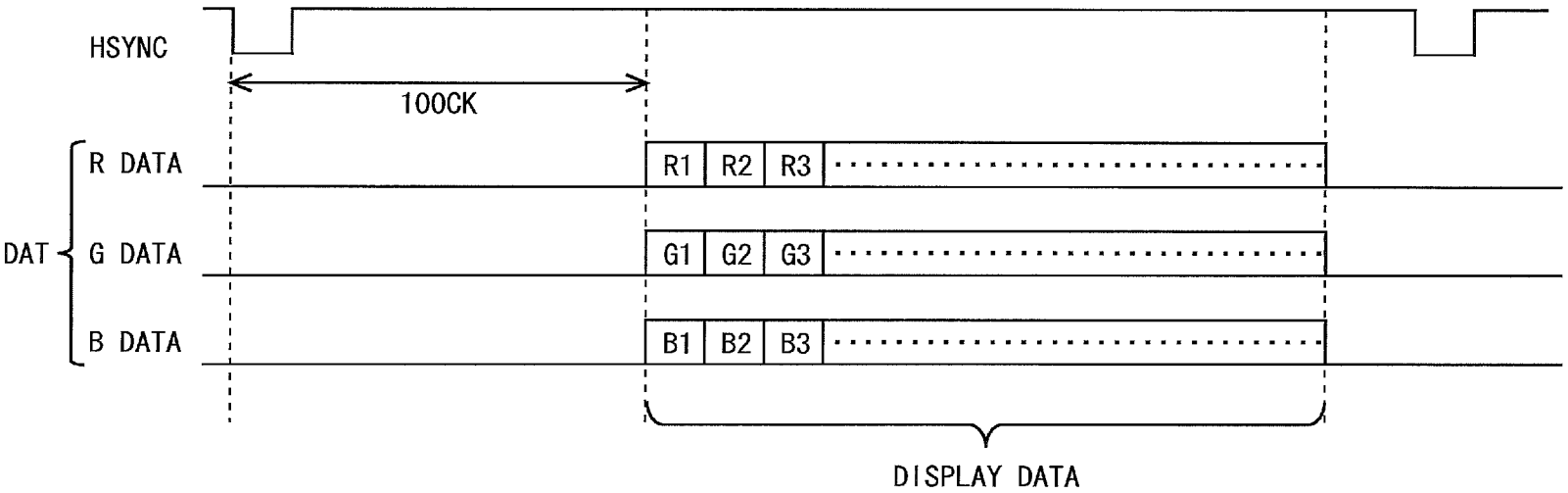
FIG. 7 is a timing chart for illustration of signals inputted to a timing controller according to the first embodiment.

In the meantime, hereinafter, the description is given based on the following assumption. As illustrated in FIG. 7, display data for actually being displayed as an image in the display unit 100 is inputted to the timing controller 200 as the image data DAT when 100 clocks have passed after the horizontal synchronization signal HSYNC has changed from a high level to a low level. The image data DAT includes R data, G data, and B data, and the three pieces of data are inputted through different signal lines. Further, a delay for internal processing is produced in the timing controller 200, after the input of the image data DAT till the output of the digital video signal DV that corresponds to the image data DAT. A delay time period for the internal processing is taken as Td, and a time point at which the time period Td has passed after a time point at which the horizontal synchronization signal HSYNC has changed from the high level to the low level is taken as a starting point of a horizontal scanning period as a unit period. It should be noted that a manner as to how the starting point of the unit period is determined is not limited to the above manner.

Figure 8:
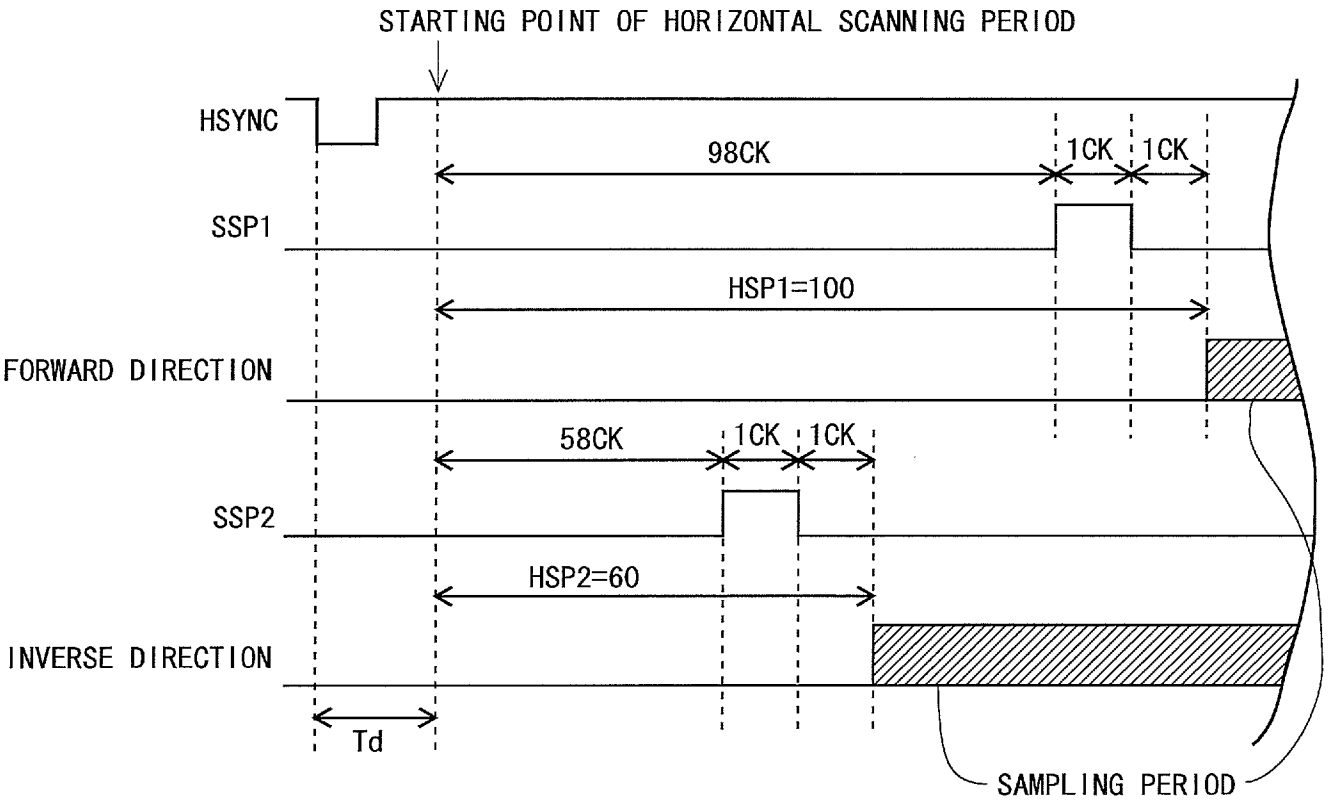
FIG. 8 is a timing chart for illustration of the generation of the source start pulse signal according to the first embodiment.

FIG. 8 is a timing chart for illustration of the generation of the source start pulse signal. Here, it is assumed that a value of the forward-direction horizontal-shifting start setting data HSP1 is set to "100", and that a value of the inverse-direction horizontal-shifting start setting data HSP2 is set to "60". It is also assumed that three pieces of display data are inputted to the source driver 300 during a time period corresponding to one clock.

Figure 9:
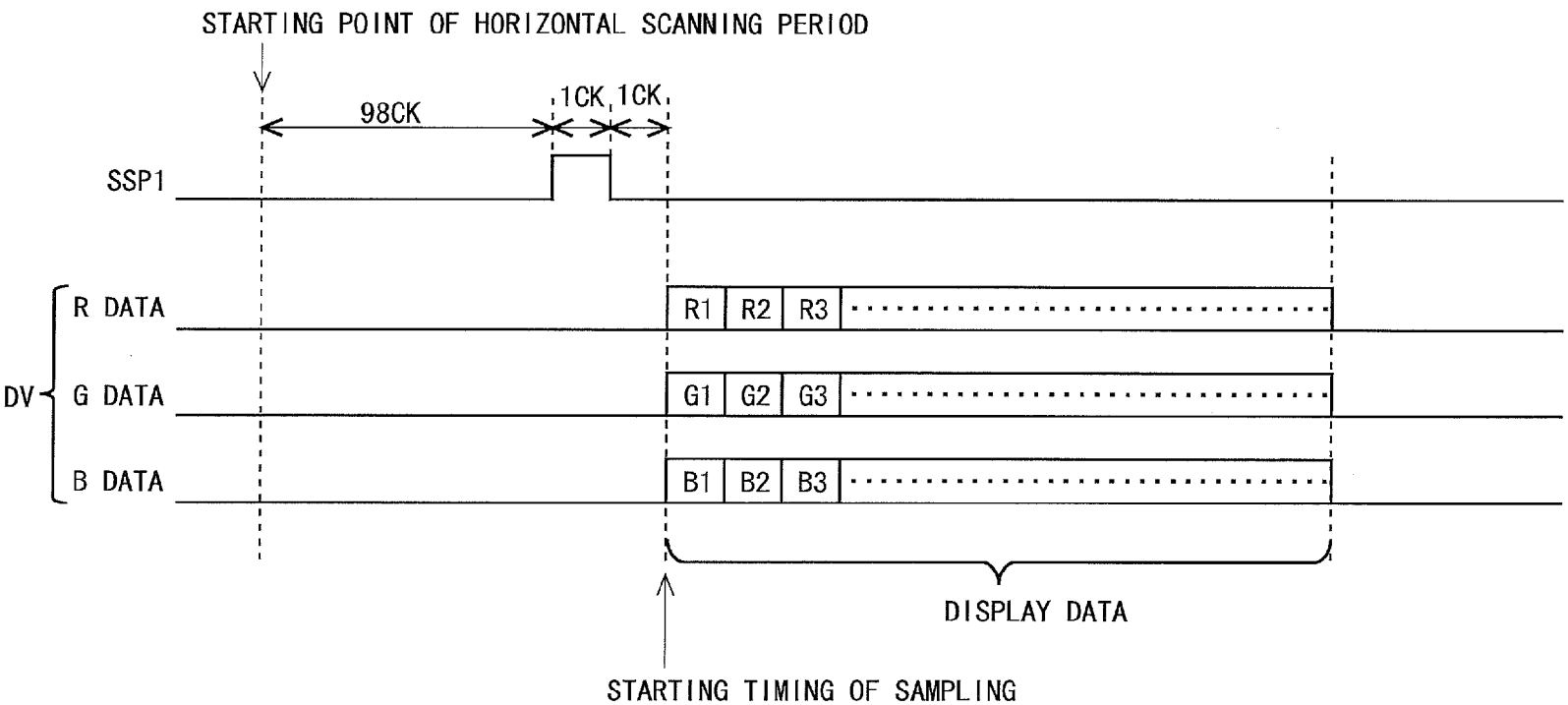
FIG. 9 is a timing chart for illustration of signals inputted to the source driver when a shifting direction is in a forward direction according to the first embodiment.
Figure 10:
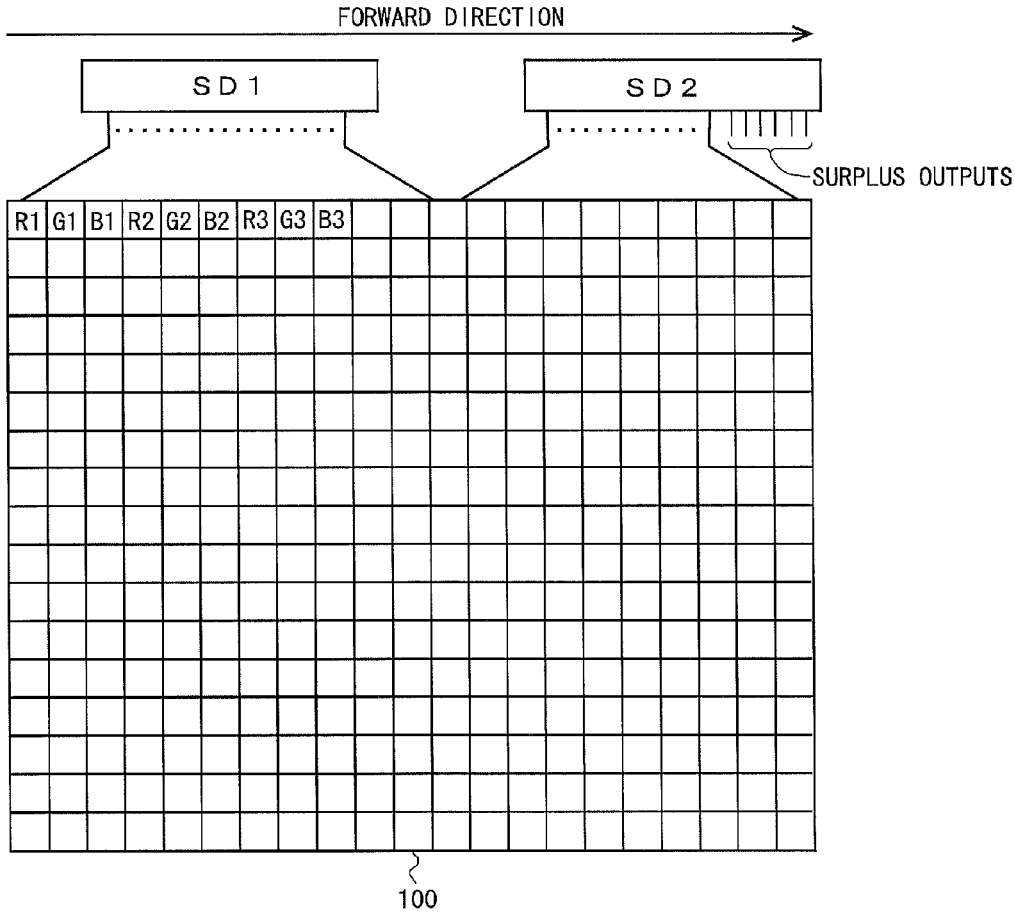
FIG. 10 is a diagram illustrating an order of writing display data to pixel capacitances when the shifting direction is in the forward direction according to the first embodiment.

When the horizontal shifting-direction instruction signal HSFT is at the low level, the first source start pulse signal SSP1 is generated so that data sampling within the source driver 300 (the sampling of the digital video signal DV by the sampling circuit 32) starts when 100 clocks have passed after the starting point of the horizontal scanning period. For example, in the case in which a RSDS transmission system is employed as a transmission system between the timing controller 200 and the source driver 300, the pulse of the first source start pulse signal SSP1 rises at timing of 98 clocks having passed after the starting point of the horizontal scanning period, as illustrated in FIG. 8. The input of the display data to the source driver 300 starts when 100 clocks have passed after the starting point of the horizontal scanning period as illustrated in FIG. 9, and the sampling by the sampling circuit 32 starts on timing of the start of the input of the display data. As a result, the display data that is sequentially inputted to the source driver 300 after 100 clocks have passed after the starting point of the horizontal scanning period is written to the pixel capacitances in order from the left side of the display unit 100 as illustrated in FIG. 10. Then, an image formed as a result of the writing to the pixel capacitances is displayed in the display unit 100 line by line.

Figure 11:
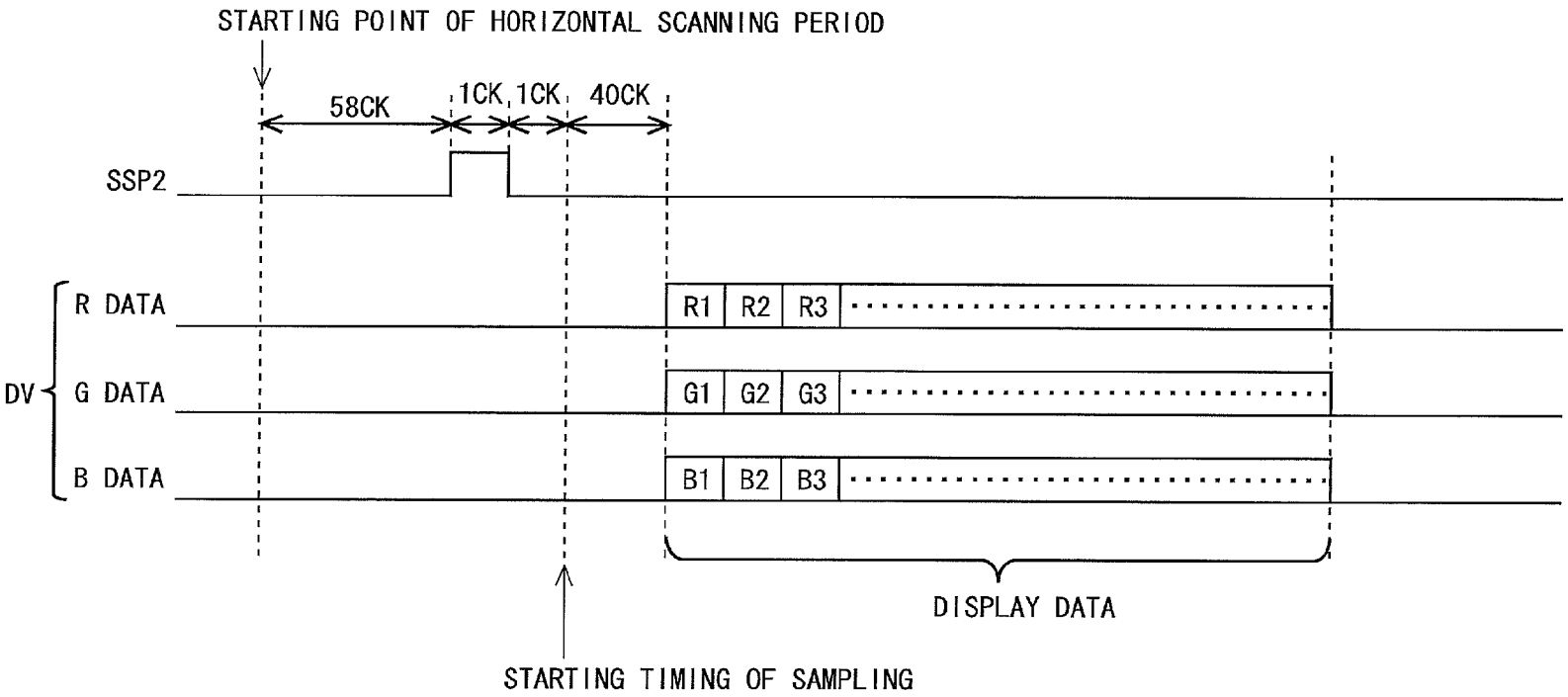
FIG. 11 is a timing chart for illustration of signals inputted to the source driver when a shifting direction is in an inverse direction according to the first embodiment.
Figure 12:
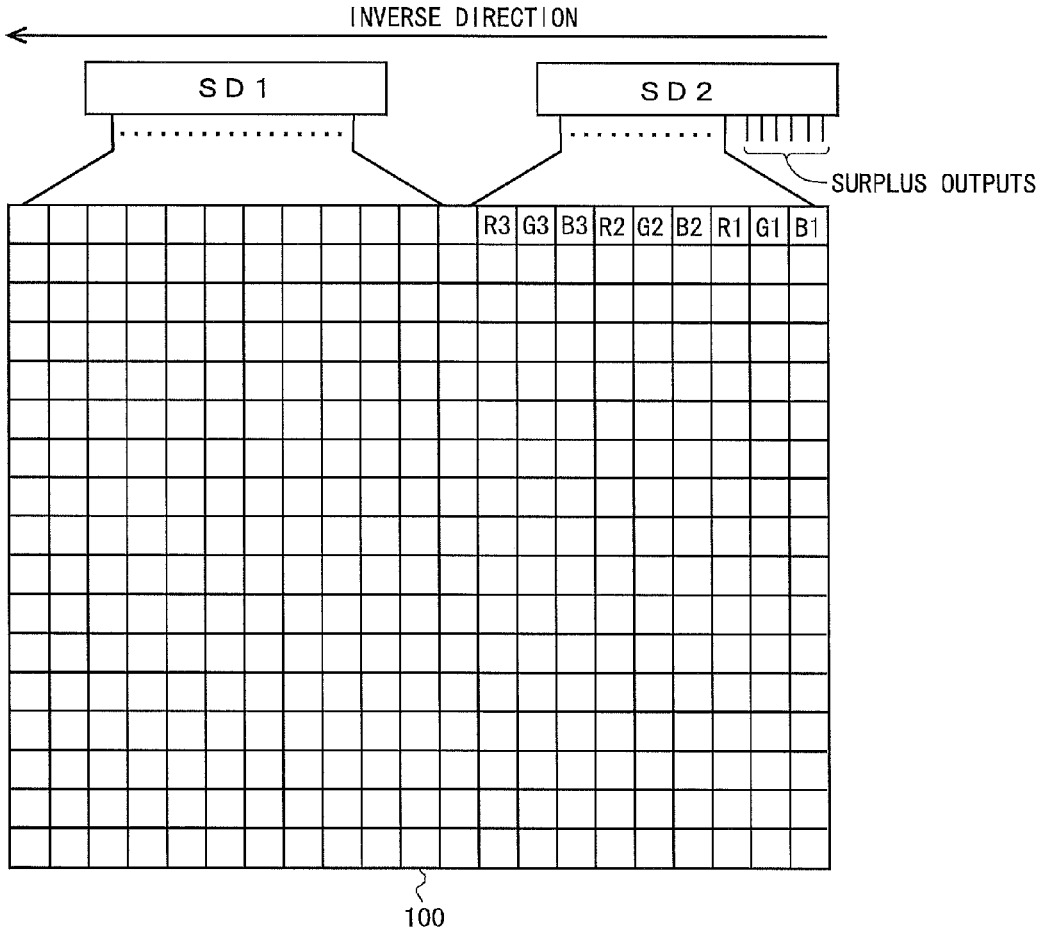
FIG. 12 is a diagram illustrating an order of writing display data to pixel capacitances when the shifting direction is in the inverse direction according to the first embodiment.

When the horizontal shifting-direction instruction signal HSFT is at the high level, the second source start pulse signal SSP2 is generated so that data sampling within the source driver 300 starts when 60 clocks have passed after the starting point of the horizontal scanning period. For example, in the case in which the RSDS transmission system is employed as the transmission system between the timing controller 200 and the source driver 300, the pulse of the second source start pulse signal SSP2 rises at timing of 58 clocks having passed after the starting point of the horizontal scanning period, as illustrated in FIG. 8. While the input of the display data to the source driver 300 starts when 100 clocks have passed after the starting point of the horizontal scanning period as illustrated in FIG. 11, the sampling by the sampling circuit 32 starts before the timing of the start of the input of the display data by 40 clocks unlike the case where the horizontal shifting-direction instruction signal HSFT is at the low level. During this period of 40 clocks, the sampling is performed for lines corresponding to the surplus outputs. As a result, the display data that is sequentially inputted to the source driver 300 after 100 clocks have passed after the starting point of the horizontal scanning period is written to the pixel capacitances in order from the right side of the display unit 100 as illustrated in FIG. 12. Then, an image formed as a result of the writing to the pixel capacitances is displayed in the display unit 100 line by line.

As described above, when the shifting direction of the shift register 31 is in the inverse direction, the sampling by the sampling circuit 32 within the source driver 300 starts at timing earlier by a time period corresponding to 40 clocks, that is, a time period required for inputting 120 pieces of display data to the source driver 300, as compared to the case when the shifting direction is in the forward direction.

<1.4 Effects>

Figure 13:
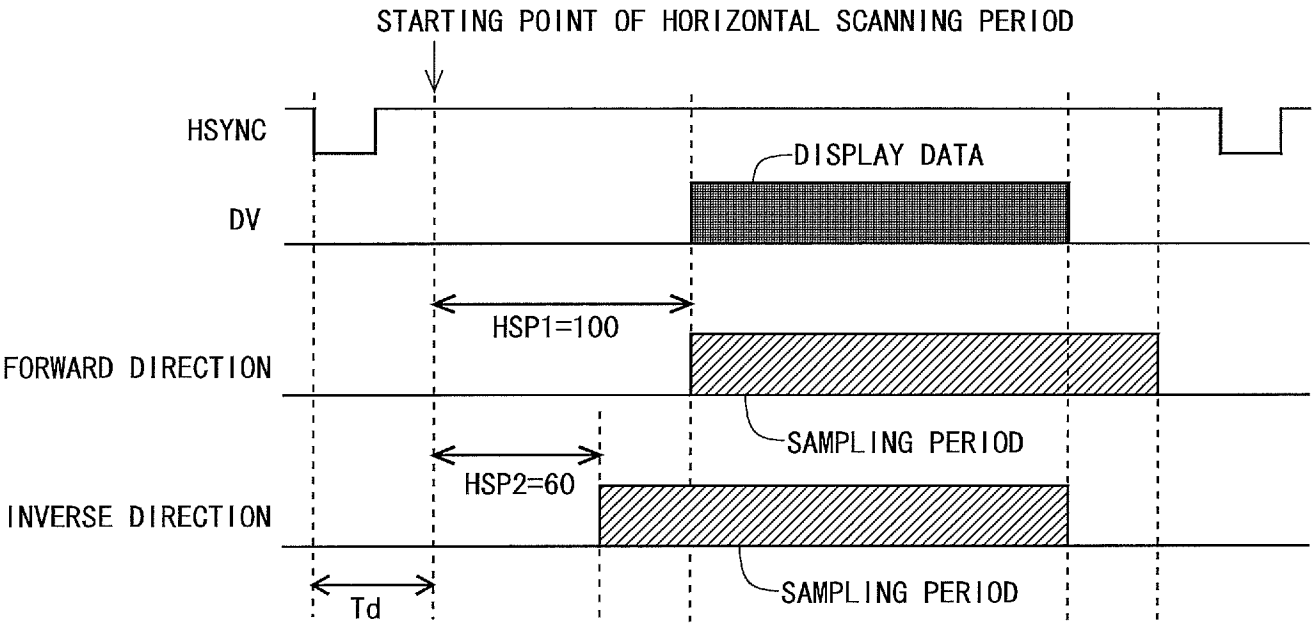
FIG. 13 is a timing chart for illustration of effects according to the first embodiment.

Effects of this embodiment will now be described with reference to FIG. 13. In this embodiment, 1800 pieces of display data per horizontal scanning period are inputted to the source driver 300 as the digital video signal DV. Here, when the shifting direction of the shift register 31 is in the forward direction, the data sampling within the source driver 300 starts on timing of the start of the input of the display data to the source driver 300. As the first stage through the 600th stage of the shift register 31 are connected to the source bus lines SL within the display unit 100, an image based on the display data is correctly displayed in the display unit 100. On the other hand, when the shifting direction of the shift register 31 is in the inverse direction, the data sampling within the source driver 300 starts at timing earlier, as compared to the forward direction, by a time period corresponding to a time period for transmitting 120 pieces of display data. Accordingly, in the source driving IC chip SD2, the display data may not be taken into the lines (the lines corresponding to the 601st stage through the 640th stage of the shift register 31) for dummy outputting, and the sampling of the display data is performed correctly from the line corresponding to the 600th stage of the shift register 31. With this, the display position of the image may not be displaced between the case in which the shifting direction of the shift register 31 is in the forward direction and the case in which the shifting direction is in the inverse direction. Further, there may not be a drop of the image when the shifting direction of the shift register 31 is made to the inverse direction. As described above, even when the shifting direction of the shift register 31 is made to the inverse direction in the case in which surplus outputs are produced in the source driver 300, an image can be displayed in the same manner as in the case in which the shifting direction is in the forward direction.

Figure 14:
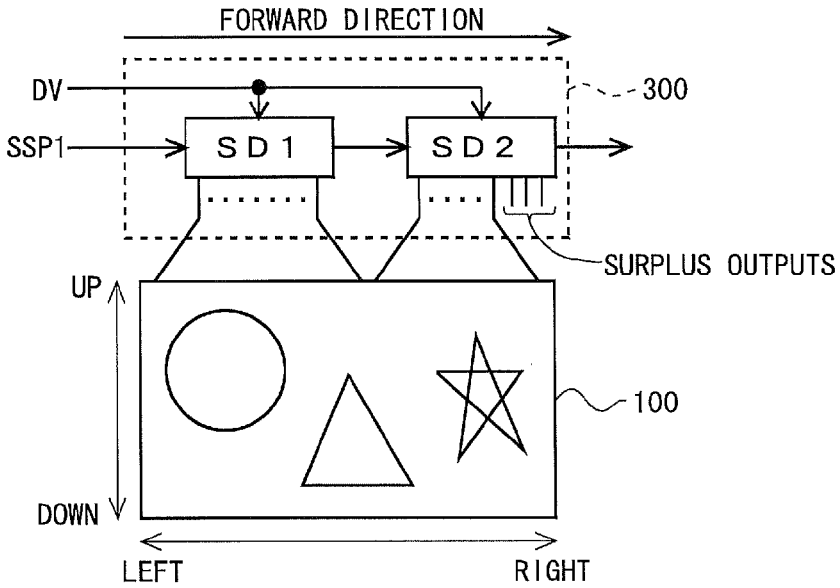
FIG. 14 is a diagram for illustration of the shifting direction in a shift register.
Figure 15:
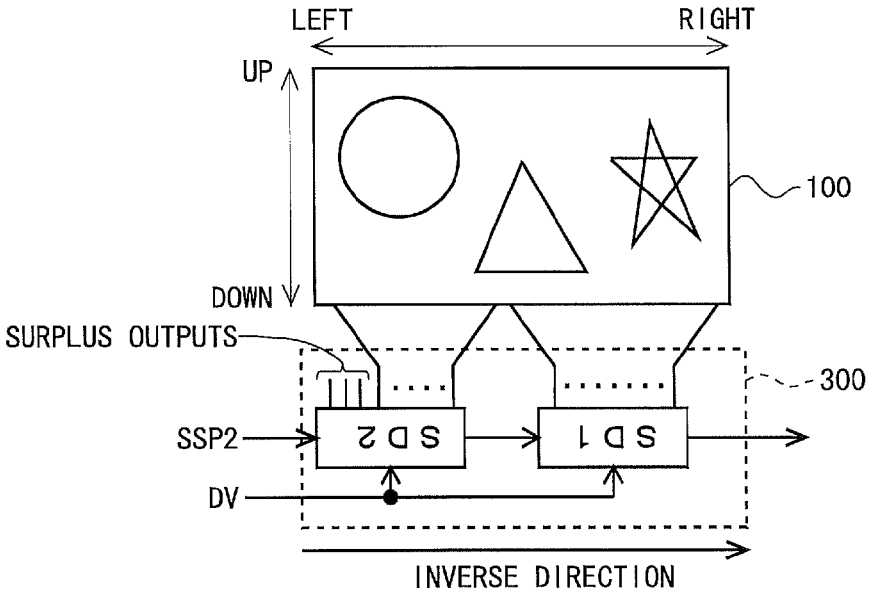
FIG. 15 is a diagram for illustration of the shifting direction in the shift register.
Figure 16:
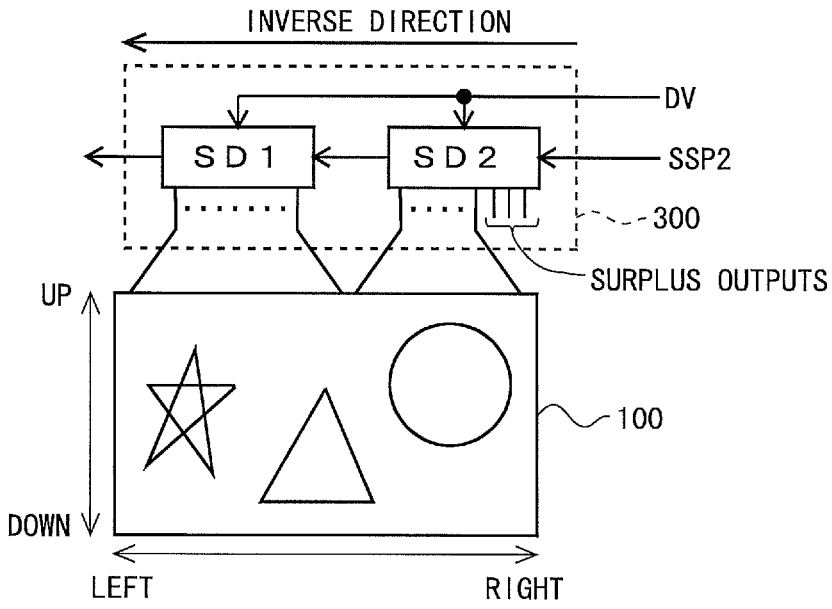
FIG. 16 is a diagram for illustration of the shifting direction in the shift register.

In the meantime, assuming that the shifting direction is made to the forward direction when the panel (the display unit 100) and the source driver 300 (the source driving IC chips SD1, SD2) are in a positional relation as illustrated in FIG. 14, the shifting direction is made to the inverse direction when a position at which the source driver 300 is mounted is upside down of the position in FIG. 14 as illustrated in FIG. 15, and when an image which is left-right reversed from that shown in FIG. 14 is to be displayed as illustrated in FIG. 16. Here, in FIG. 15, the characters of "SD1" and "SD2" are shown upside down in order to clearly show a positional relation between the output terminals of the source driving IC chips SD1, SD2 and the display unit 100. Focusing on a relation between the shifting direction of the shift register 31 and the image displayed in the display unit 100 in FIG. 14 to FIG. 16, regarding the data transmitted to the source driver 300 from the timing controller 200 as the digital video signal DV, it can be seen that an order of the data can be the same between the case in which the shifting direction is in the forward direction and the case in which the shifting direction is in the inverse direction. Therefore, a process for changing the order of the data in the timing controller 200 is not necessary. Further, as can be seen from FIG. 13, the timing at which the display data is supplied to the source driver 300 as the digital video signal DV can also be the same between the case in which the shifting direction is in the forward direction and the case in which the shifting direction is in the inverse direction. In other words, a process for changing the timing at which the display data is outputted from the timing controller 200 according to the shifting direction (e.g., a process for delaying) is not necessary as well. As described above, according to this embodiment, it is not necessary to provide a line memory or a frame memory to make the shifting direction to the inverse direction, and thus it is possible to prevent increase in cost and increase in consumption current.

<2. Second Embodiment>

<2.1 Configuration, Etc.>

Figure 17:
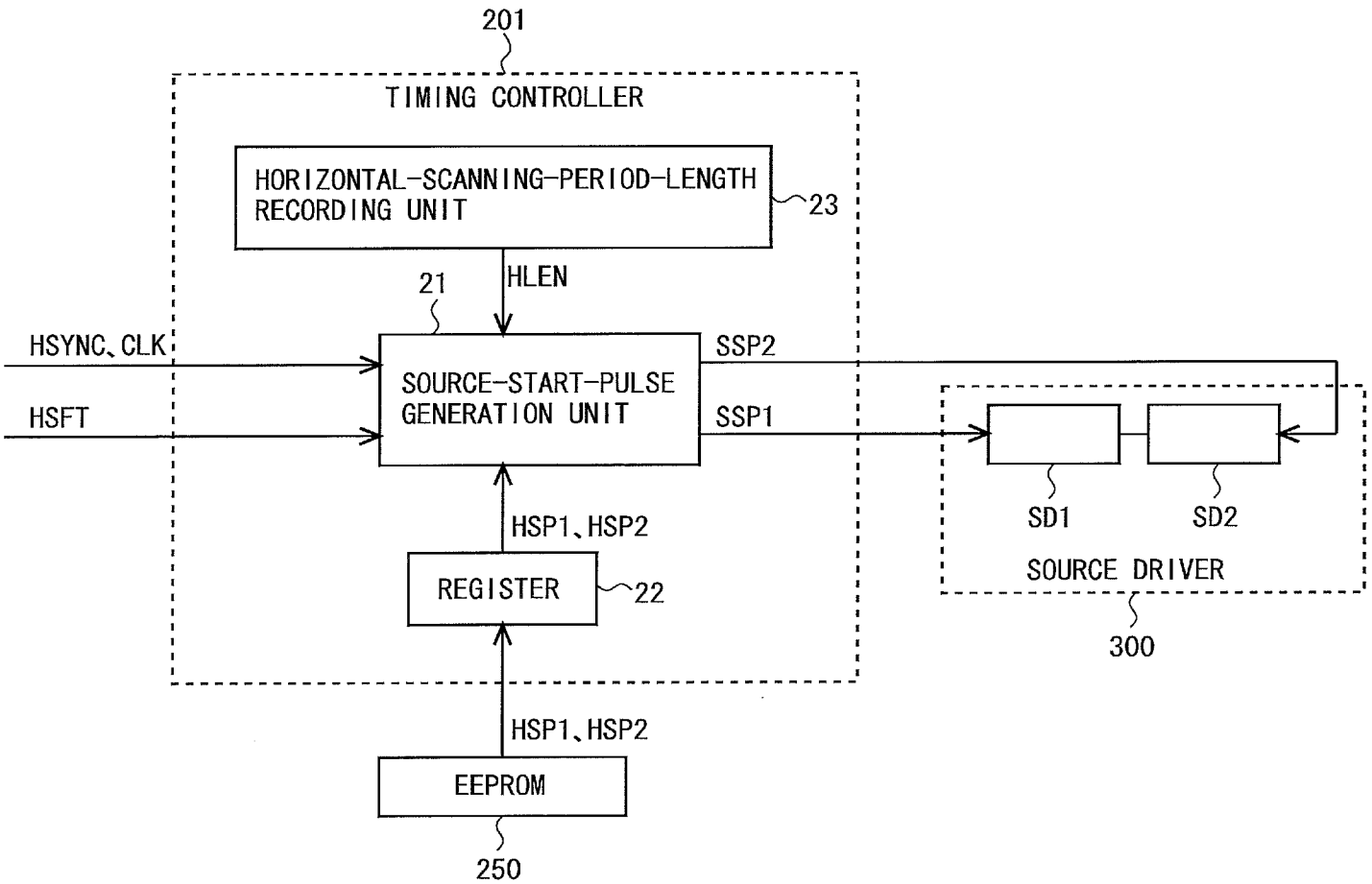
FIG. 17 is a block diagram illustrating a configuration of a main part relating to generation of a source start pulse signal in a liquid crystal display device according to a second embodiment of the present invention.

In this embodiment, an entire configuration and a configuration of the driving unit are the same as the first embodiment, and descriptions for these configurations are omitted. FIG. 17 is a block diagram illustrating a configuration of a main part relating to generation of a source start pulse signal according to this embodiment. A timing controller 201 is provided with a horizontal-scanning-period-length recording unit 23 in addition to the components as described in the first embodiment. The horizontal-scanning-period-length recording unit 23 stores data (hereinafter referred to as "horizontal scanning period length data") HLEN that indicates the length of a single horizontal scanning period. It should be noted that the number of clocks is typically used as the horizontal scanning period length data, and thus the following description is given assuming such. Further, in this embodiment, the horizontal-scanning-period-length recording unit 23 realizes a unit-period-length recording unit, and the horizontal scanning period length data HLEN realizes a unit period length data.

In this embodiment, it is possible to set a negative value for the horizontal-shifting start setting data. When the horizontal-shifting start setting data is set to be a negative value, the source-start-pulse generation unit 21 generates the source start pulse signal based on the horizontal synchronization signal HSYNC and the clock CLK, referring to the horizontal-shifting start setting data within the register 22 and the horizontal scanning period length data HLEN within the horizontal-scanning-period-length recording unit 23. In the meantime, while it is necessary to cause a pulse of the source start pulse signal to rise earlier than the starting point of each horizontal scanning period when the horizontal-shifting start setting data is set to be a negative value, it is possible to derive the number of clocks after the starting point of each horizontal scanning period at which the data sampling within the source driver 300 should be started, by adding the horizontal-shifting start setting data to the horizontal scanning period length data HLEN.

Figure 18:
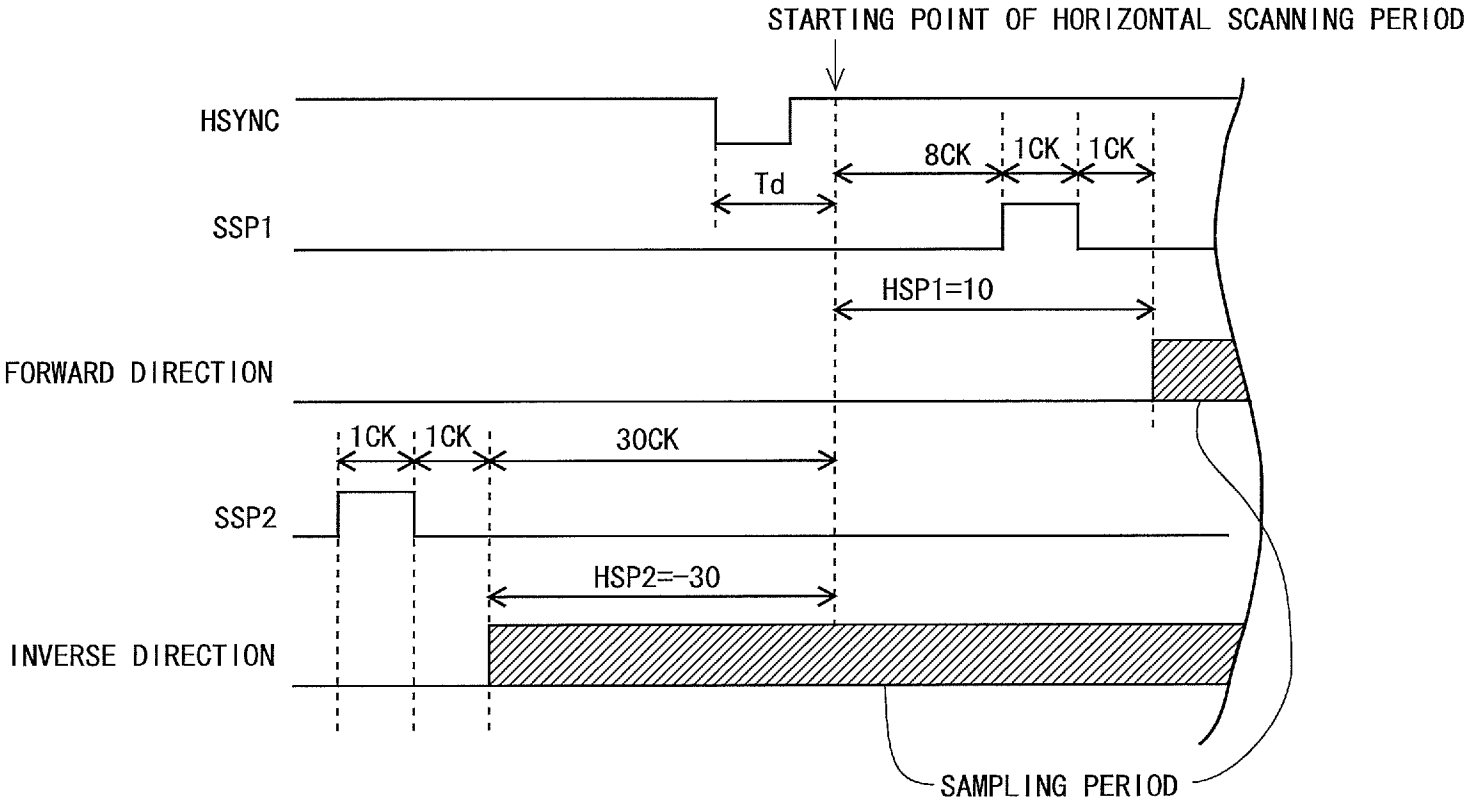
FIG. 18 is a timing chart for illustration of the generation of the source start pulse signal according to the second embodiment.

FIG. 18 is a timing chart for illustration of the generation of the source start pulse signal. Here, it is assumed that a value of the forward-direction horizontal-shifting start setting data HSP1 is set to "10", and that a value of the inverse-direction horizontal-shifting start setting data HSP2 is set to "−30". When the horizontal shifting-direction instruction signal HSFT is at the low level, the first source start pulse signal SSP1 is generated so that data sampling within the source driver 300 starts when 10 clocks have passed after the starting point of the horizontal scanning period. For example, in the case in which the RSDS transmission system is employed as a transmission system between the timing controller 201 and the source driver 300, the pulse of the first source start pulse signal SSP1 rises at timing of 8 clocks having passed after the starting point of the horizontal scanning period, as illustrated in FIG. 18. When the horizontal shifting-direction instruction signal HSFT is at the high level, the second source start pulse signal SSP2 is generated so that data sampling within the source driver 300 starts before the timing of the starting point of the horizontal scanning period by 30 clocks. For example, in the case in which the RSDS transmission system is employed as a transmission system between the timing controller 201 and the source driver 300, the pulse of the second source start pulse signal SSP2 rises before the timing of the starting point of the horizontal scanning period by 32 clocks, as illustrated in FIG. 18.

<2.2 Effects>

Figure 19:
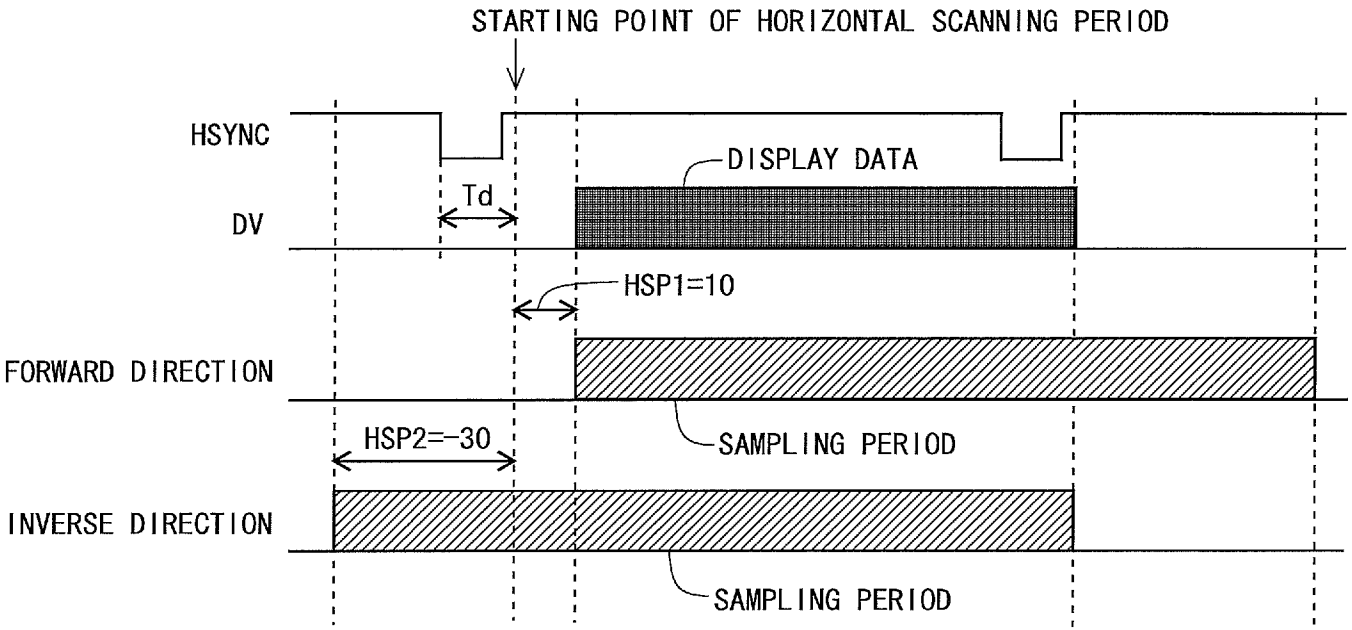
FIG. 19 is a timing chart for illustration of effects according to the second embodiment.

Effects of this embodiment will now be described with reference to FIG. 19. According to this embodiment, the following effects can be obtained in addition to the effects similar to those in the first embodiment. Similarly to the first embodiment, when the shifting direction of the shift register 31 is in the forward direction, the data sampling within the source driver 300 starts on timing of the start of the input of the display data to the source driver 300. With this, an image based on the display data is correctly displayed in the display unit 100. On the other hand, when the shifting direction of the shift register 31 is in the inverse direction, the data sampling within the source driver 300 starts at timing earlier by 30 clocks from the starting point of the horizontal scanning period. During the time period corresponding to the 30 clocks and the time period corresponding to 10 clocks after the starting point of the horizontal scanning period until the sampling of the display data stars (during the time period of total 40 clocks), the data sampling for the lines for dummy outputting is performed. At this time, the display data may not be taken into the lines for dummy outputting. Then, after the data sampling for the lines for dummy outputting is completed, the sampling of the display data starts, and the image is displayed so that the display position is not displaced from the case of the forward direction. In this manner, by setting the value of the horizontal-shifting start setting data appropriately, the data sampling for the lines for dummy outputting can be performed before starting the horizontal scanning period, and thus the horizontal back porch can be reduced. With this, it is possible to reduce the length of a single horizontal scanning period, to reduce a clock frequency, and to reduce consumption current.

<3. Third Embodiment>

While a bidirectional shift register is employed as the shift register within the source driver according to the first and the second embodiment described above, a bidirectional shift register is employed as the shift register within the gate driver in this embodiment. Here, it is assumed that a specially-shaped panel is employed as the liquid crystal panel, and that the number of pixels along a direction in which the source bus lines SL extend is 760.

<3.1 Configuration of Gate Driver>

Figure 20:
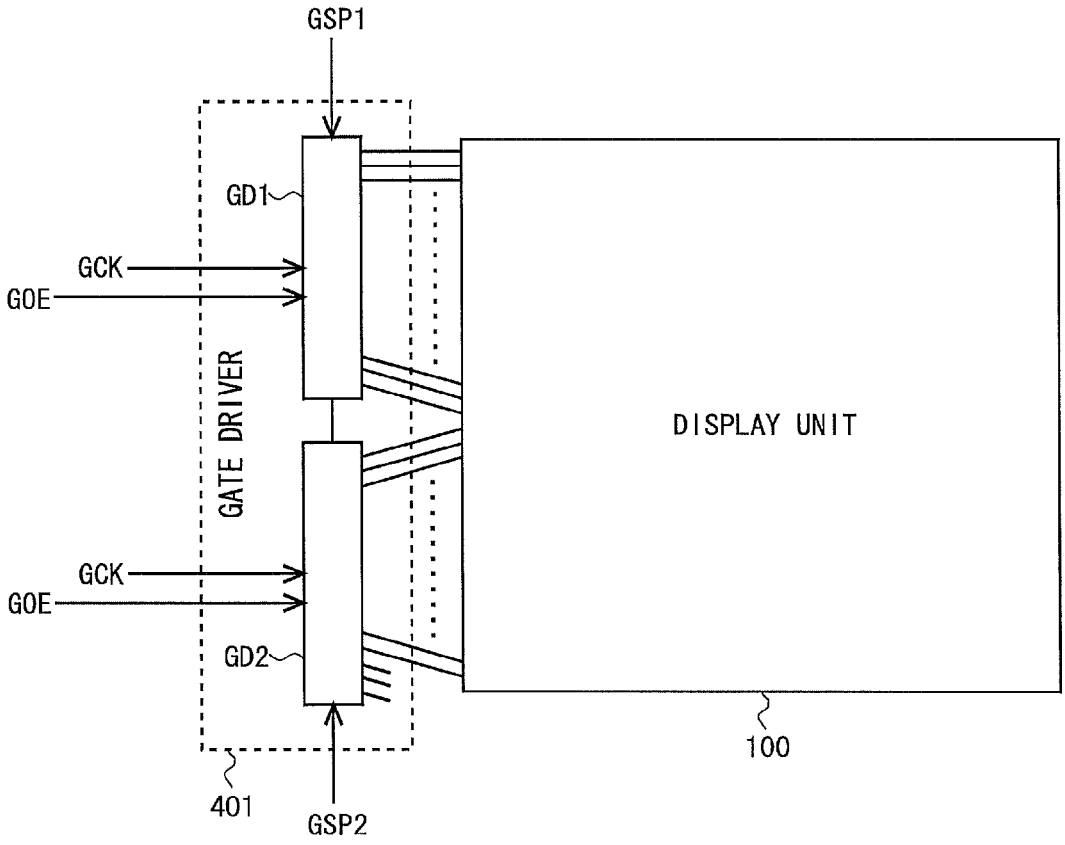
FIG. 20 is a block diagram illustrating a general configuration of agate driver according to a third embodiment.

Similarly to the first embodiment, a gate driver 401 according to this embodiment is configured by the two semiconductor chips (the gate driving IC chips GD1, GD2). Each of the gate driving IC chips is provided with 400 output terminals. As for the gate driving IC chip GD1, all of the output terminals are connected to the gate bus lines GL within the display unit 100. As for the gate driving IC chip GD2, as illustrated in FIG. 20, although 360 output terminals are connected to the gate bus lines GL within the display unit 100, the remaining 40 output terminals are not connected to the gate bus lines GL within the display unit 100. In other words, in the gate driving IC chip GD2, 40 surplus outputs are produced.

Figure 21:
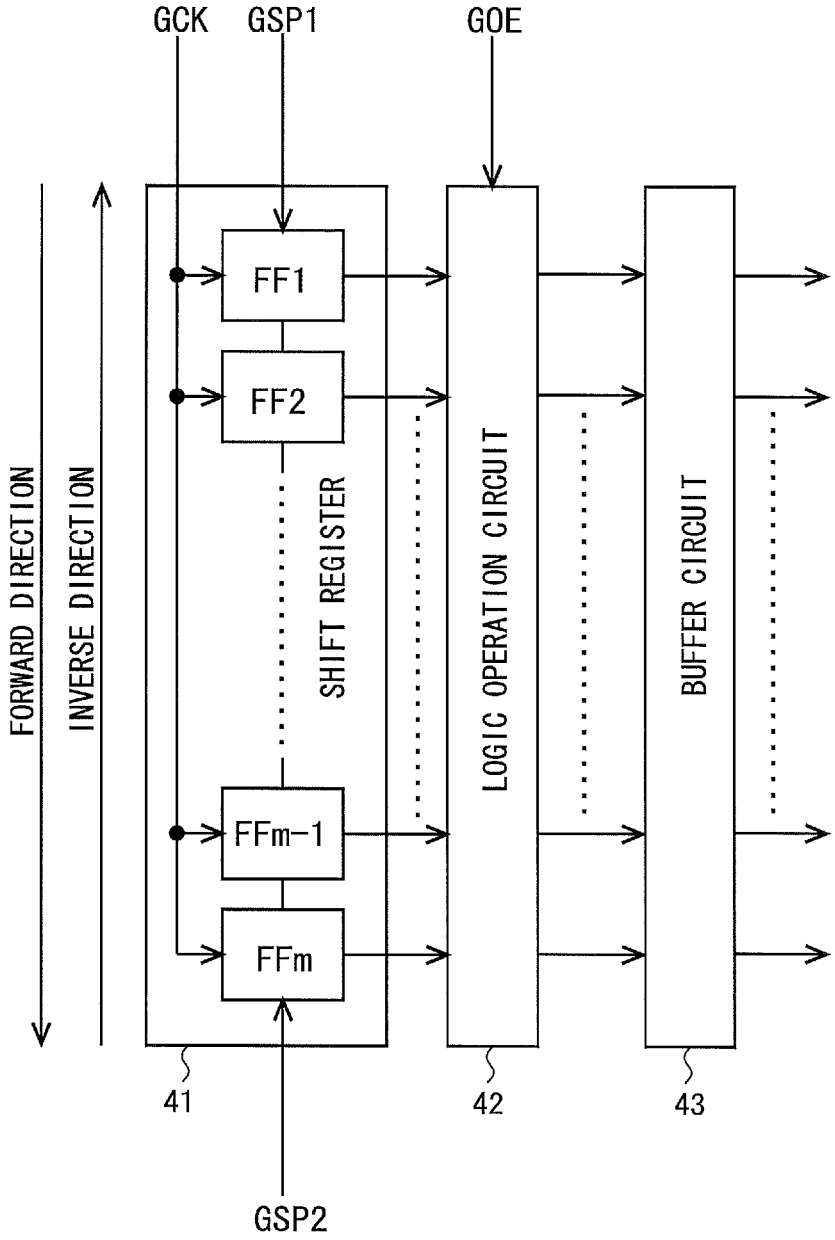
FIG. 21 is a block diagram illustrating a functional configuration of the gate driver according to the third embodiment.

FIG. 21 is a block diagram illustrating a functional configuration of the gate driver 401 according to this embodiment. This is substantially the same configuration as that of the first embodiment (see FIG. 6), however in this embodiment, one of a first gate start pulse signal GSP1 and a second gate start pulse signal GSP2 is inputted as the gate start pulse signal to the shift register 41. Here, when a shifting direction of data in the shift register 41 is made to a forward direction (a direction from FF1 toward FFm), the first gate start pulse signal GSP1 is inputted to the flip-flop FF1 of a first stage in the shift register 41, whereas when the shifting direction is made to an inverse direction (a direction from FFm toward FF1), the second gate start pulse signal GSP2 is inputted to the flip-flop FFm of an m-th stage in the shift register 41.

<3.2 Generation of Gate Start Pulse Signal>

Figure 22:
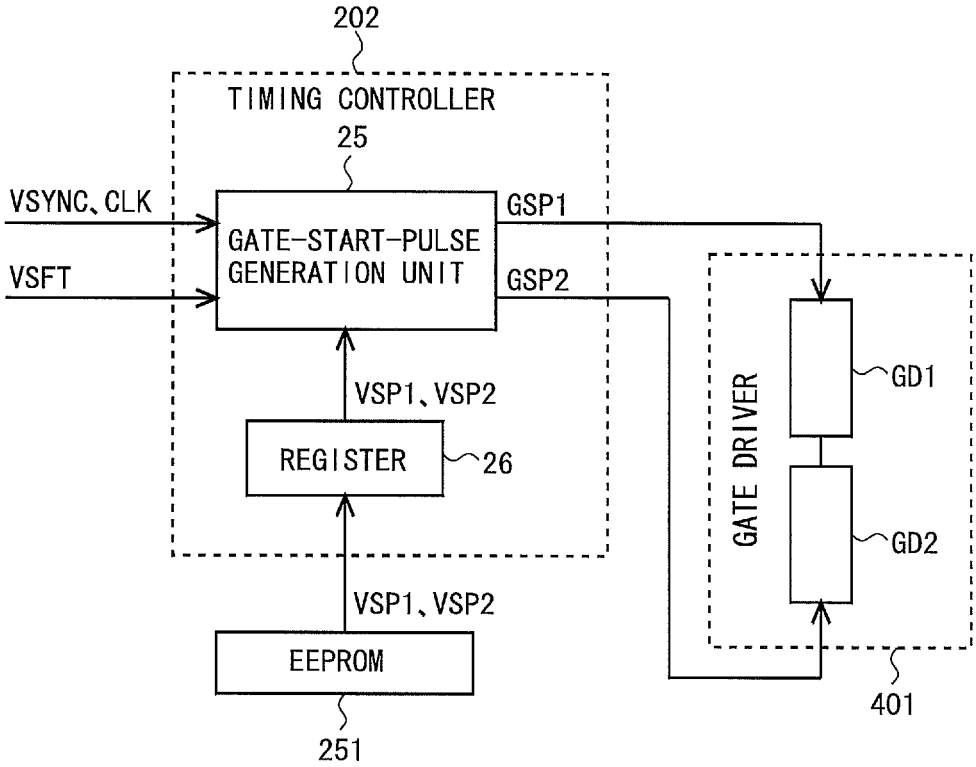
FIG. 22 is a block diagram illustrating a configuration of a main part relating to generation of agate start pulse signal according to the third embodiment.

FIG. 22 is a block diagram illustrating a configuration of a main part relating to the generation of the gate start pulse signal. In this embodiment, a timing controller 202 is provided with, as components for generating the gate start pulse signal, a gate-start-pulse generation unit 25 and a register 26. Here, in this embodiment, the gate-start-pulse generation unit 25 realizes a shifting-operation-start instruction signal generation unit.

To the timing controller 202, a vertical shifting-direction instruction signal VSFT is inputted, in place of the horizontal shifting-direction instruction signal HSFT in the first embodiment. An EEPROM 251 previously stores data (hereinafter referred to as "vertical-shifting start setting data") indicating the length of a period (vertical back porch) from a starting point of each vertical scanning period to a time point at which shifting (transfer) of data (here, the gate start pulse signal) is to be started in the shift register 41. Specifically, the vertical-shifting start setting data for a case in which the shifting direction of the shift register 41 is made to the forward direction is stored in the EEPROM 251 as forward-direction vertical-shifting start setting data VSP1, and the vertical-shifting start setting data for a case in which the shifting direction of the shift register 41 is made to the inverse direction is stored in the EEPROM 251 as inverse-direction vertical-shifting start setting data VSP2. In this embodiment, the forward-direction vertical-shifting start setting data VSP1 realizes the first period length data, and the inverse-direction vertical-shifting start setting data VSP2 realizes the second period length data. It should be noted that the number of clocks is typically used as the vertical-shifting start setting data, and thus the following description is given assuming such.

The register 26 is configured to be able to store the forward-direction vertical-shifting start setting data VSP1 and the inverse-direction vertical-shifting start setting data VSP2. Then, upon power activation of this liquid crystal display device, the forward-direction vertical-shifting start setting data VSP1 and the inverse-direction vertical-shifting start setting data VSP2 previously stored in the EEPROM 251 are read to the register 26. It should be noted that in the following description, it is assumed that the vertical shifting-direction instruction signal VSFT is a digital signal, the vertical shifting-direction instruction signal VSFT is set to a low level when the shifting direction of the shift register is made to the forward direction, and the vertical shifting-direction instruction signal VSFT is set to a high level when the shifting direction of the shift register 41 is made to the inverse direction.

The gate-start-pulse generation unit 25 generates the gate start pulse signal (the first gate start pulse signal GSP1 or the second gate start pulse signal GSP2) based on the vertical synchronization signal VSYNC, the clock CLK, and the vertical shifting-direction instruction signal VSFT. Specifically, when the vertical shifting-direction instruction signal VSFT is at the low level, the gate-start-pulse generation unit 25 generates the first gate start pulse signal GSP1 based on the vertical synchronization signal VSYNC and the clock CLK, referring to the forward-direction vertical-shifting start setting data VSP1 within the register 26. On the other hand, when the vertical shifting-direction instruction signal VSFT is at the high level, the gate-start-pulse generation unit 25 generates the second gate start pulse signal GSP2 based on the vertical synchronization signal VSYNC and the clock CLK, referring to the inverse-direction vertical-shifting start setting data VSP2 within the register 26. Here, in this embodiment, the first gate start pulse signal GSP1 realizes the first shifting-operation-start instruction signal, and the second gate start pulse signal GSP2 realizes the second shifting-operation-start instruction signal.

<3.3 Effects>

In this embodiment, in the gate driver 401, 800 pulses per vertical scanning period are outputted from the shift register 41 to the logic operation circuit 42. Here, by setting the value of the forward-direction vertical-shifting start setting data VSP1 and the inverse-direction vertical-shifting start setting data VSP2 appropriately, the scanning signals that become active in a sequential manner are applied to the gate bus lines GL within the display unit 100 during a time period in which driving video signals corresponding to an image for a single frame (a single screen) are outputted from the source driver 300, regardless of whether the shifting direction of the shift register 41 is in the forward direction or in the inverse direction. With this, even when the shifting direction of the shift register 41 is made to the inverse direction in the case in which surplus outputs are produced in the gate driver 401, an image can be displayed in the same manner as in the case in which the shifting direction is in the forward direction.

It should be noted that, similarly to the second embodiment, by providing the configuration in which the gate start pulse signal is generated based on the data indicating the length of a single vertical scanning period and the vertical-shifting start setting data set to a negative value, it is possible to reduce the length of a single vertical scanning period.

<4. Others (Modified Examples)>

In each of the above embodiments, the description is given relating to the case in which surplus outputs are produced in one of the source driver and the gate driver. However, the present invention is not limited to such an example, and the present invention can be applied to a case in which surplus outputs are produced in both of the source driver and the gate driver.

Further, in each of the above embodiments, the description is given taking the liquid crystal display device as an example. However, the present invention is not limited to such an example. The present invention can be applied to other types of display devices such as an organic EL (Electro Luminescence).

Figure 23:
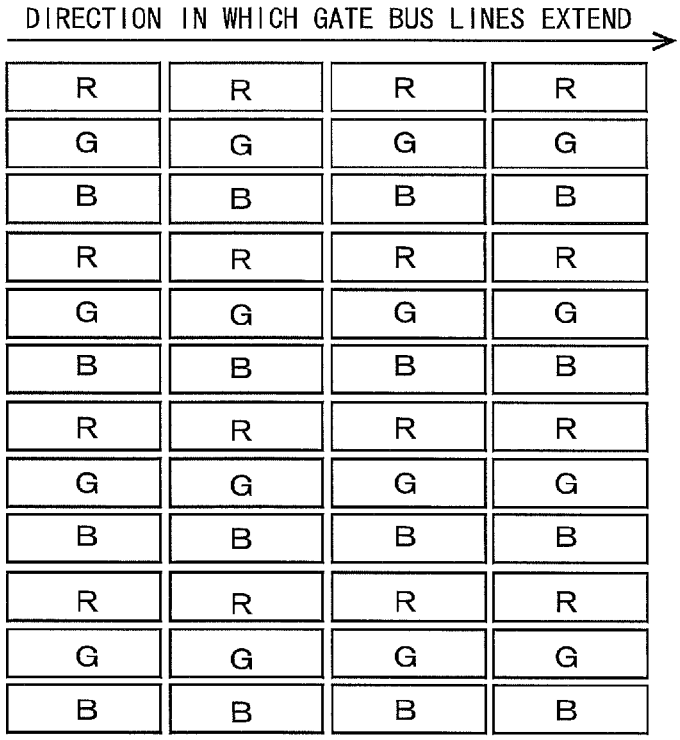
FIG. 23 is a diagram for illustration of a configuration of pixels in the liquid crystal display device according to a modified example.

As for the configuration of the pixels of the liquid crystal display device, typically, there are the configuration in which, as illustrated in FIG. 3, each sub-pixel is in an elongate shape (vertically long shape) along the direction in which the source bus lines extend, and the sub-pixels of the same color are arranged in succession along the direction in which the source bus lines extend, and the configuration in which, as illustrated in FIG. 23, each sub-pixel is in an elongate shape (horizontally long shape) along the direction in which the gate bus lines extend, and the sub-pixels of the same color are arranged in succession along the direction in which the gate bus lines extend. In the case of the configuration illustrated in FIG. 3, sampling of three pieces of display data is performed by a single sampling pulse within the source driver. In contrast, in the case of the configuration illustrated in FIG. 23, sampling of a single piece of display data is performed by a single sampling pulse within the source driver. Further, in the case of the configuration illustrated in FIG. 3, selection of a single gate bus line is performed in a single horizontal scanning period. In contrast, in the case of the configuration illustrated in FIG. 23, since the number of gate bus lines is three times larger than that in the configuration illustrated in FIG. 3, selection of a single gate bus line is performed in one-third horizontal scanning period. Specifically, in the case of the configuration illustrated in FIG. 23, the scanning speed of the gate bus lines is three times faster than that in the configuration illustrated in FIG. 3. While the description in each of the above embodiments is given assuming that the configuration of the pixels is as illustrated in FIG. 3, the present invention can also be applied to a liquid crystal display device having the configuration of the pixels illustrated in FIG. 23.

Figure 24:
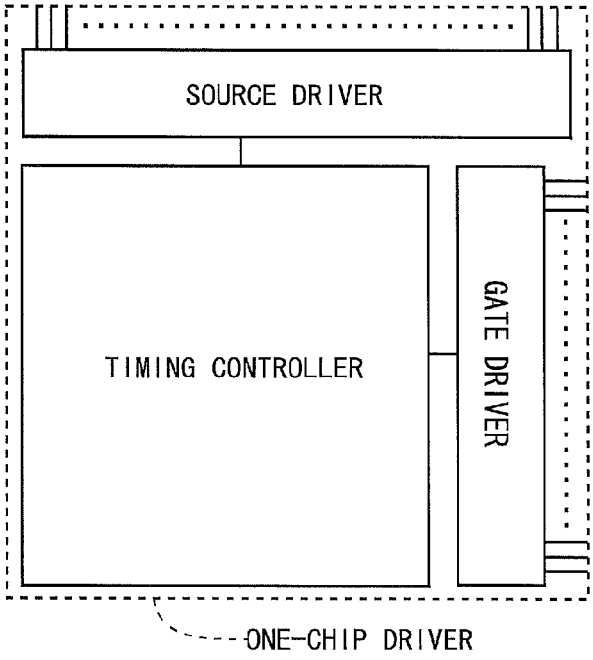
FIG. 24 is a block diagram illustrating a configuration of a one-chip driver relating to the modified example.
Figure 25:
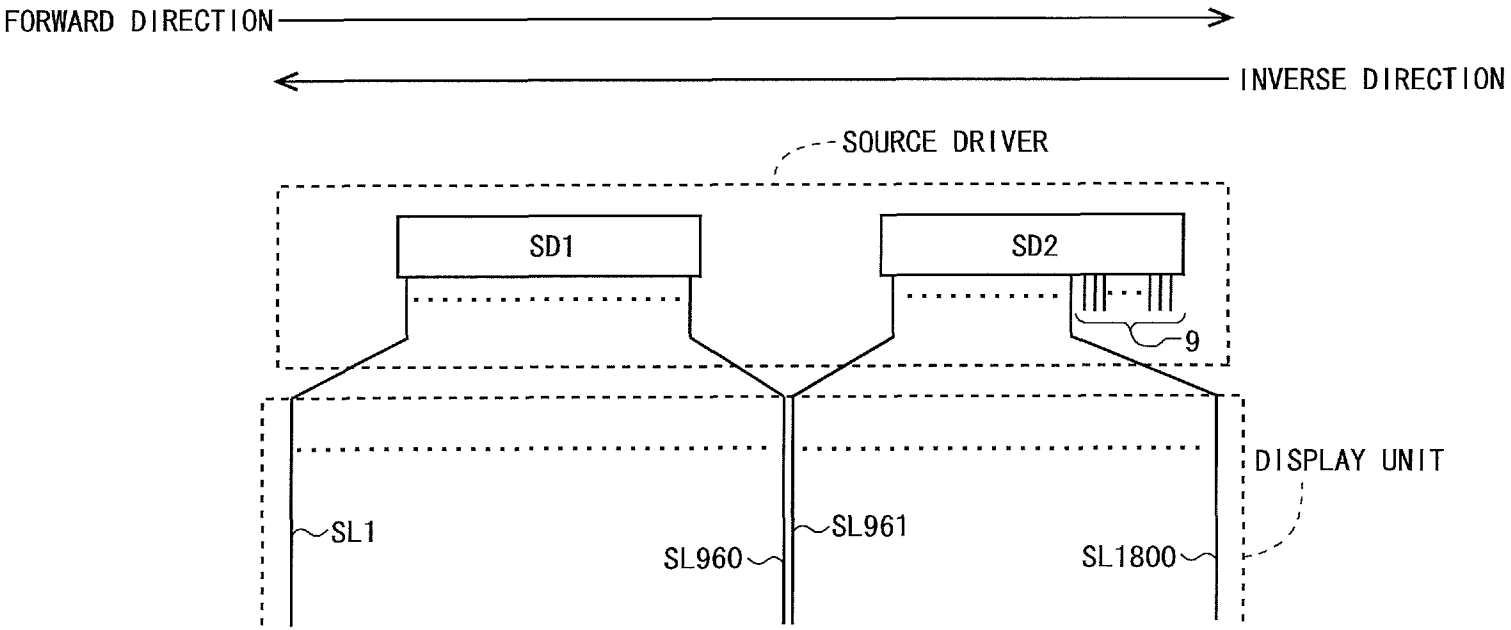
FIG. 25 is a diagram for illustration of a conventional example.

In recent years, a so-called "one-chip driver" in which a timing controller, a source driver, a gate driver, and the like are integrated into a single semiconductor chip is often employed as an IC for driving a liquid crystal panel (see FIG. 24). Such a one-chip driver is provided with a large number of output terminals for connection with source bus lines and gate bus lines. In the meantime, also in the one-chip driver, surplus outputs may be produced in the source driver or in the gate driver. Further, also in the source driver or in the gate driver within the one-chip driver, there is a case in which the shifting direction of the shift register should be made to the inverse direction. Thus, also in such a one-chip driver, in the case in which surplus outputs are produced in the source driver, operating the source driver in the manner similar to the first embodiment or the second embodiment allows the image display to be performed in the same manner both in the case in which the shifting direction of the shift register is in the forward direction and in the case in which the shifting direction is in the inverse direction. Further, in the case in which surplus outputs are produced in the gate driver, operating the gate driver in the manner similar to the third embodiment allows the image display to be performed in the same manner both in the case in which the shifting direction of the shift register is in the forward direction and in the case in which the shifting direction is in the inverse direction.

Description of Reference Characters

21: SOURCE-START-PULSE GENERATION UNIT
22, 26: REGISTER
25: GATE-START-PULSE GENERATION UNIT
31: SHIFT REGISTER (WITHIN SOURCE DRIVER)
32: SAMPLING CIRCUIT
41: SHIFT REGISTER (WITHIN GATE DRIVER)
100: DISPLAY UNIT
200, 201, 202: TIMING CONTROLLER
250, 251: EEPROM
300: SOURCE DRIVER
400, 401: GATE DRIVER
SD1, SD2: SOURCE DRIVING IC CHIP
GD1, GD2: GATE DRIVING IC CHIP
HSYNC: HORIZONTAL SYNCHRONIZATION SIGNAL
VSYNC: VERTICAL SYNCHRONIZATION SIGNAL
HSP1: FORWARD-DIRECTION HORIZONTAL-SHIFTING START SETTING DATA
HSP2: INVERSE-DIRECTION HORIZONTAL-SHIFTING START SETTING DATA
VSP1: FORWARD-DIRECTION VERTICAL-SHIFTING START SETTING DATA
VSP2: INVERSE-DIRECTION VERTICAL-SHIFTING START SETTING DATA
HLEN: HORIZONTAL SCANNING PERIOD LENGTH DATA
HSFT: HORIZONTAL SHIFTING-DIRECTION INSTRUCTION SIGNAL
VSFT: VERTICAL SHIFTING-DIRECTION INSTRUCTION SIGNAL
SSP1: FIRST SOURCE START PULSE SIGNAL
SSP2: SECOND SOURCE START PULSE SIGNAL
GSP1: FIRST GATE START PULSE SIGNAL
GSP2: SECOND GATE START PULSE SIGNAL

The invention claimed is:

1. A display device comprising a display unit; a plurality of signal lines disposed in the display unit; and a signal line driving unit including a bidirectional shift register having a plurality of output stages, the signal line driving unit being configured to drive the plurality of signal lines based on pulses outputted sequentially from the plurality of output stages along with a shifting operation of the bidirectional shift register, wherein the display device comprises:

a register unit configured to store first period length data and second period length data, the first period length data indicating a length of a time period from a starting point of a unit period till a time point at which the shifting operation of the bidirectional shift register is to be started when a shifting direction of the bidirectional shift register is in a first direction, the second period length data indicating a length of a time period from a starting point of a unit period till a time point at which the shifting operation of the bidirectional shift register is to be started when the shifting direction of the bidirectional shift register is in a second direction which is an inverse direction of the first direction; and a shifting-operation-start instruction signal generation unit configured to generate a first shifting-operation-start instruction signal and a second shifting-operation-start instruction signal as signals indicating starting timing of the shifting operation of the bidirectional shift register in the respective unit periods, the first shifting-operation-start instruction signal causing the signal line driving unit to operate so that the shifting direction of the bidirectional shift register is in the first direction, the second shifting-operation-start instruction signal causing the signal line driving unit to operate so that the shifting direction of the bidirectional shift register is in the second direction, wherein the shifting-operation-start instruction signal generation unit receives a shifting-direction instruction signal indicating the shifting direction of the bidirectional shift register, and generates the first shifting-operation-start instruction signal based on the first period length data when the shifting-direction instruction signal indicates the first direction, and the second shifting-operation-start instruction signal based on the second period length data when the shifting-direction instruction signal indicates the second direction.

2. The display device according to claim 1, further comprising:

a non-volatile memory configured to store the first period length data and the second period length data, wherein the first period length data and the second period length data are read from the non-volatile memory to the register unit after power activation.

3. The display device according to claim 1, further comprising:

a unit-period-length recording unit configured to store unit period length data indicating a length of the unit period, wherein the register unit is configured to be able to store a negative value for at least one of the first period length data and the second period length data, and the shifting-operation-start instruction signal generation unit generates the first shifting-operation-start instruction signal based on the unit period length data and the first period length data when the first period length data takes the negative value in a case in which the shifting-direction instruction signal indicates the first direction, and the second shifting-operation-start instruction signal based on the unit period length data and the second period length data when the second period length data takes the negative value in a case in which the shifting-direction instruction signal indicates the second direction.

4. The display device according to claim 1, wherein a plurality of video signal lines as the plurality of signal lines are disposed in the display unit, and the signal line driving unit is a video signal line driving unit configured to drive the plurality of video signal lines.

5. The display device according to claim 1, wherein a plurality of scanning signal lines as the plurality of signal lines are disposed in the display unit, and the signal line driving unit is a scanning signal line driving unit configured to drive the plurality of scanning signal lines.

6. The display device according to claim 1, wherein a plurality of video signal lines and a plurality of scanning signal lines as the plurality of signal lines are disposed in the display unit, and the signal line driving unit is constituted by a video signal line driving unit configured to drive the plurality of video signal lines and a scanning signal line driving unit configured to drive the plurality of scanning signal lines.

7. The display device according to claim 6, further comprising:

a timing signal generation unit including the register unit and the shifting-operation-start instruction signal generation unit, and configured to generate a timing signal for controlling operations of the video signal line driving unit and the scanning signal line driving unit, wherein at least two of the video signal line driving unit, the scanning signal line driving unit, and the timing signal generation unit are formed within a single semiconductor chip.

8. The display device according to claim 1, wherein the signal line driving unit is constituted by one or more semiconductor chips including a semiconductor chip having a dummy terminal as an output terminal that is not connected to any of the plurality of signal lines, and data indicating a length of a time period in which the shifting operation of the bidirectional shift register is performed in output stages, each corresponding to the dummy terminal, out of the plurality of output stages is stored in the register unit as one of the first period length data and the second period length data.

9. A driving method of a display device including a display unit; a plurality of signal lines disposed in the display unit; and a signal line driving unit including a bidirectional shift register having a plurality of output stages, the signal line driving unit being configured to drive the plurality of signal lines based on pulses outputted sequentially from the plurality of output stages along with a shifting operation of the bidirectional shift register, the method comprising:

a shifting-direction instruction signal receiving step of receiving a shifting-direction instruction signal indicating a shifting direction of the bidirectional shift register; and a shifting-operation-start instruction signal generating step of generating one of a first shifting-operation-start instruction signal and a second shifting-operation-start instruction signal as a signal indicating starting timing of the shifting operation of the bidirectional shift register in each unit period, the first shifting-operation-start instruction signal causing the signal line driving unit to operate so that the shifting direction of the bidirectional shift register is in a first direction, the second shifting-operation-start instruction signal causing the signal line driving unit to operate so that the shifting direction of the bidirectional shift register is in a second direction which is an inverse direction of the first direction, wherein the display device further includes a register unit configured to store first period length data and second period length data, the first period length data indicating a length of a time period from a starting point of a unit period till a time point at which the shifting operation of the bidirectional shift register is to be started when the shifting direction of the bidirectional shift register is in the first direction, the second period length data indicating a length of a time period from a starting point of a unit period till a time point at which the shifting operation of the bidirectional shift register is to be started when the shifting direction of the bidirectional shift register is in the second direction, and in the shifting-operation-start instruction signal generating step, the first shifting-operation-start instruction signal is generated based on the first period length data when the shifting-direction instruction signal indicates the first direction, and the second shifting-operation-start instruction signal is generated based on the second period length data when the shifting-direction instruction signal indicates the second direction.

* * * * *